US005278943A

United States Patent [19]

Gasper et al.

[11] Patent Number: 5,278,943

[45] Date of Patent: Jan. 11, 1994

[54] SPEECH ANIMATION AND INFLECTION SYSTEM

[75] Inventors: Elon Gasper, Bellevue; Richard Wesley, Seattle, both of Wash.

[73] Assignee: Bright Star Technology, Inc., Bellevue, Wash.

[21] Appl. No.: 884,256

[22] Filed: May 8, 1992

Related U.S. Application Data

[63] Continuation of Ser. No. 497,937, Mar. 23, 1990, abandoned.

[51] Int. Cl.[5] ..... G10L 9/00

[52] U.S. Cl. ..... 395/2

[58] Field of Search ..... 381/51-53; 395/2; 434/185

[56] References Cited

U.S. PATENT DOCUMENTS

| | | | |
|---|---|---|---|
| 4,685,135 | 8/1987 | Lin et al. | 381/52 |
| 4,689,817 | 8/1987 | Kroon | 381/52 |
| 4,695,962 | 9/1987 | Goudie | 381/51 |
| 4,700,322 | 10/1987 | Benbassat et al. | 381/51 |
| 4,717,261 | 1/1988 | Kita et al. | 381/51 |
| 4,731,847 | 3/1988 | Lybrook et al. | 381/51 |
| 4,831,654 | 5/1989 | Dick | 381/51 |
| 4,884,972 | 12/1989 | Gasper | 434/185 |
| 4,888,806 | 12/1989 | Jenkin et al. | 381/51 |
| 4,907,279 | 3/1990 | Higuchi et al. | 381/52 |
| 4,912,768 | 3/1990 | Benbassat | 381/52 |
| 4,975,957 | 12/1990 | Ichikawa et al. | 381/52 |

*Primary Examiner*—Michael R. Fleming
*Assistant Examiner*—Michelle Doerrler
*Attorney, Agent, or Firm*—LaRiviere & Grubman

[57] ABSTRACT

A voice animation system decomposes pre-recorded samples of actual speech into basic segments to derive speech patterns of a particular speaker to provide parameters and coefficients for use in a text-to-speech synthesizer to artificially synthesize human quality speech with unlimited vocabulary in the voice of the person who provided the pre-recorded samples. The pre-recorded speech samples are further processed to add desired inflection and other auditory effects to create high-quality animated or artificial voices.

13 Claims, 22 Drawing Sheets

| WIND | ID | NAME |
|---|---|---|
| 1 | 117 | DEBUGGING WINDOW |
| 2 | 100 | CURRENT WORD |
| 3 | 105 | CURRENT SEGMENT |
| 4 | 104 | RECORDING STUDIO |
| 5 | 106 | WORD LIST |
| 6 | 107 | SEGMENT LIST |
| 7 | 109 | DICTIONARY EDITOR |
| 8 | 110 | FILE INFORMATION |
| 9 | 111 | RULES EDITOR |
| 10 | 112 | RECORDER |
| 11 | 113 | SPLICING TABLE |
| 12 | 114 | CURRENT PHONEME |
| 13 | 115 | PHONEME LIST |
| 14 | 116 | SLICING TABLE |
| 15 | 119 | BRIGHT TALK™ |
| 16 | 120 | SCRATCH PAD |
| 17 | 122 | CUTE PHRASES |
609
FIG. 7a
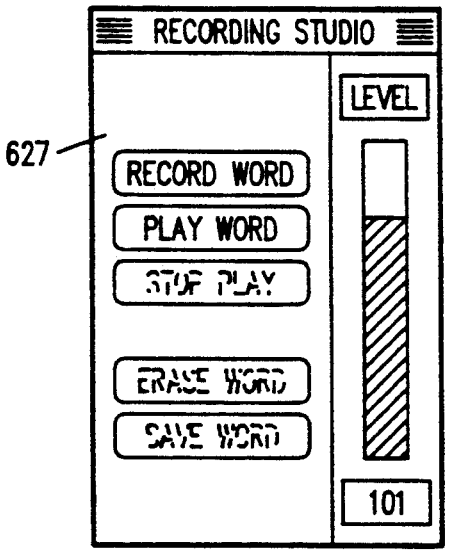
FIG. 7c
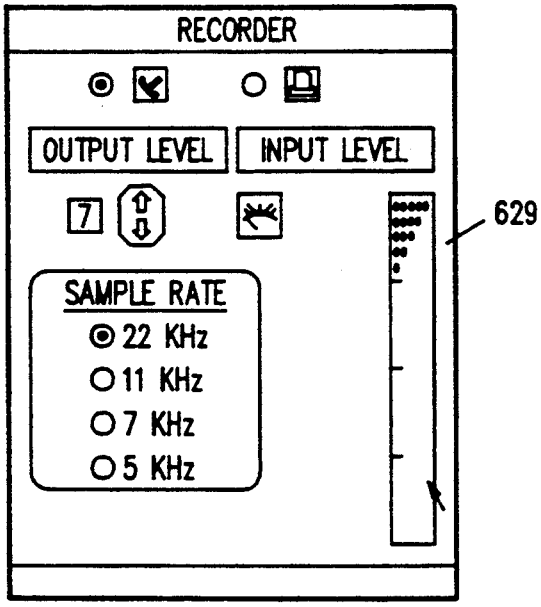
FIG. 7d

REFERENCE

NEW REFERENCE ⌘N
OPEN REFERENCE ⌘O
CLOSE REFERENCE ⌘D
DELETE REFERENCE

NEW SEGMENTATION
SET SEGMENTATION
DELETE SEGMENTATION

RECORDING STUDIO ⌘D
SLICING TABLE ⌘K
SPLICING TABLE ⌘T

QUIT ⌘Q

81

FIG. 8a

DICTIONARY

NEW DICTIONARY
OPEN DICTIONARY
CLOSE DICTIONARY ⌘D
DELETE DICTIONARY

ADD WORD ⌘A
REMOVE WORD ⌘W
NEW SEGMENTS FROM CURRENT WORD ⌘N

DICTIONARY EDITOR ⌘E

82

FIG. 8b

VOICE

✓STRESS
PROSODY
✓BLENDING
✓SUBSTITUTION

84

FIG. 8d

LANGUAGE

NEW LANGUAGE
OPEN LANGUAGE
CLOSE LANGUAGE ⌘D
DELETE LANGUAGE

NEW RULES
DELETE RULES

RULES EDITOR ⌘L

83

FIG. 8c

SHORTCUTS

REBUILD LISTS
SAVE LISTS
DISPLAY SEGMENT SOURCES
DISPLAY PHONEME SOURCES
DELETE CUT SEGMENT ⌘U
REMEMBER WINDOW LOCATIONS
BATCH MODE SLICE...
BATCH MODE SLICE FROM SCRATCH PAD
IMPACT OF CURRENT SEGMENT
ADD WORDS TO DICT FROM SCRATCH PAD
AWTDFS ONLY IF IT PROVIDES NEW SEGS

86

FIG. 8f

WINDOWS

85

PHONEME ⌘P
SEGMENTS ⌘S
WORDS ⌘W

FILE INFORMATION ⌘I
RECORDER SETTINGS ⌘M
CUTE PHRASES

FIG. 8e

DEBUGGING

DEBUGGING WINDOW ⌘=
SEARCH SCRIPTS ⌘Z
FIND IN FIELD ⌘F

87

FIG. 8g

SPEECH ANIMATION AND INFLECTION SYSTEM

CROSS REFERENCE TO RELATED APPLICATION

This is a continuation of application Ser. No. 07/497,937, filed Mar. 23, 1990, now abandoned.

BACKGROUND OF THE INVENTION

The present invention relates generally to text-to-speech synthesis and more particularly to a system for synthesizing animated human quality speech having unlimited vocabulary from prerecorded utterances of basic speech segments.

It is well-known in the prior art to provide synthetic speech from a machine. Early attempts to imitate man's speech invariably took the form of mechanical devices. Modern day efforts invariably developed in electrical terms. Good synthetic speech from machines has been possible for at least the last twenty years, but only with the use of complex minicomputers costing tens of thousands of dollars. However, in recent years both the cost and size of the electronic hardware involved have decreased steadily, and in the process have crossed various thresholds of feasibility for commercial applications of speech synthesis. These prior art systems typically have limited flexibility, being handcrafted and hardwired to synthesize a specific voice. Moreover, no prior art system provides mimicry of a particular person's voice.

Speech consists of a continuously changing complex sound wave resulting from constantly changing aerodynamic and resident conditions in the human vocal track appropriate to the generation of different sounds. Speech synthesis depends on the ability to break down the speech wave into component elements and combine these elements to create new messages. A speech synthesis system which is likely to provide human quality speech must be closely based on the human linguistic system underlying speech events.

The human vocal system is a relatively complex structure including the lungs which supply an airflow through the vocal cords and glottis into the larynx through the oral cavity and out through the lips. The human vocal track includes many different places at which it can change its cross-sectional area, either to alter its resonance characteristics or actually to produce acoustic energy. When one considers the variable degrees of narrowing at each of these articulation sites, and the possibilities for their simultaneous combination, it becomes apparent that the number of acoustically different sounds that can be produced is vast.

Sound can be generated in the vocal system in three ways. Voiced sounds are produced by elevating the air pressure in the lungs, forcing a flow through the glottis, the vocal cord orifice, and causing the vocal cords to vibrate. Fricative sounds of speech are generated by forming a constriction at some point in the vocal track and forcing air through the constriction at a sufficiently high Reynold's number to produce turbulence. Plosive sounds result from making a complete closure, usually towards the front of the vocal track, building up pressure behind the closure and abruptly releasing it.

Typically, speech synthesis involves a modeling of the human vocal tract. The cursive digital filters generate quantized samples of the speech signal. The control functions which specify the resonances, anti-resonances and excitation of the filter must be supplied externally. Generally a linear predictive coding (LPC) method is utilized to provide the necessary filter control functions. A basic model utilized in the LPC method has two major components: a flat spectrum excitation source and a spectral shaping filter. For speech synthesis, the parameters of the spectral shaping filter are set on a time varying basis such that its short term spectrum is the same as the short term speech spectral envelope desired. A prediction error function is derived from the difference between the desired speech signal and the actual synthetic speech signal and is used as the excitation signal for the model. A drawback to using the prediction error function as the excitation signal is the large storage requirements. An effective solution to the storage problem has been to model the excitation signal as coming from one of two sources: a pulse source or a noise source. However, the resulting speech quality is mechanical and tinny and is not as natural as using the prediction error function.

SUMMARY OF THE INVENTION

The present invention provides a voice animation system which decomposes prerecorded samples of actual speech into basic segments to derive the speech patterns of a particular speaker to provide basic building block parameters and coefficients for use in a text-to-speech synthesizer to produce non-mechanical human quality speech with unlimited vocabulary in the voice of the person who provided the prerecorded samples. Moreover, these speech samples may be further processed to add desired auditory effects and thereby create high-quality animated or artificial voices. A voice animation system constructed according to the principles of the present invention comprises two major components, a voice editor and a voice animator. The voice editor originates and maintains a library of recorded speech samples or utterances for a particular person's voice, breaks up or segments the utterances into basic speech segments and stores the segments in a segment library for reassembly by the voice animator. The voice animator basically comprises a text-to-speech speech synthesizer which draws from the segment library to create synthetic speech from a specified text input by a user. The synthetic speech thus produced has the characteristics and sound of the particular person who provided the speech samples to make up the segment library. A segment dictionary is also included to cross-reference the speech segments to their source speech samples or utterances. The voice animation system can be adapted to any language, any speech segmentation methodology and any desired data representation scheme. The synthetic speech output can be directed to any desired output medium and synchronized with an external system. The synthetic speech thus created can be synchronized with a visual animation system to create audio-visual animation of the original speaker or to create new talking agents having the image of one speaker and the speech patterns of another. Multiple speaker-specific libraries provide the capability to mimicking the voice of any one of several speakers.

The voice editor is utilized to create libraries of data representing speech fragments or segments which can be concatenated together and blended to form natural sounding speech in a given language. These speech fragments are referred to as segments and stand for or realize the functional sound types of the human vocal tract. A consistent set of speech fragments or segments is referred to as a segmentation scheme or simply as a segmentation. Words, demisyllables and phonemes are all examples of segmentations. These segmentations can be extracted from a set of recordings of a person's voice. Generally, the same set of recorded utterances can be segmented or cutup in different ways to produce several different segmentations. The voice editor therefore maintains a single library of recorded utterances for each person's voice being animated which can be broken up in different ways to provide many different segmentations. Language segmentations are defined separately to allow use by different speakers.

In order to create a segmentation, not only is it required to know which segments need to be extracted, but also which recorded utterances contain those segments. For this reason, each segmentation has a segment dictionary associated with it which comprises essentially a look-up table of possible sources of a particular segment. Since the recorded utterances may not exactly match the standard pronunciation of the language being used, the segment dictionary is speaker specific; although it may be originally created from a standard dictionary then later modified by the user. While a recorded utterance may be segmented manually this is a lengthy and tedious process. The voice editor incorporates speech segmentation algorithms which analyze a complete set of recorded utterances and extract the required segments automatically. The voice editor includes display means for visually displaying of a selected utterance and its component segments so that a user may verify and adjust segmentation data if necessary. Any given speech segment may be present in several different recordings and moreover the prosodic characteristics (e.g., the pitch and volume) may be different for each segment occurrence. The voice editor extracts as many of the segment occurrences as the user desires, together with a description of the prosodic environment for each segment occurrence. It is usually impractical to extract and store every possible segment for a given segmentation scheme. Typically a subset of the entire segmentation will work almost as well as the entire set if a set of rules are used to substitute available segments for any missing segments. The voice editor includes a mechanism for the user to create and edit a set of substitution rules for mapping the complete set of segments for the segmentation scheme onto a smaller subset of actually extracted segments. Utilizing these rules, the voice animator can create uninterrupted speech from an incomplete set of segments.

With any given language, a set of rules is required to convert standard written text to a phonetic representation of the language. This is especially important in a language such as English where the spelling often appears unrelated to the pronunciation. A phonically spelled language such as Russian can have a very short set of text to phonetic rules while a language such as Chinese may require a context sensitive pronunciation mapping for every character. The voice editor includes a mechanism enabling the user to create a set of text to phonetics rules for each desired language.

For a particular language, different segmentation schemes may be appropriate. For example, there are over 10,000 common syllables in English, but only about 1,500 common diphones or demisyllables. Clearly one of the later segmentation schemes is the appropriate choice for English. Conversely, a language such as Japanese which has a very limited set of syllables may be amenable to a syllable-based segmentation approach. The voice editor enables the user to define and use segmentations appropriate to the language used by the speaker.

In the English language there are approximately 43 phonemes and, therefore, the vocabulary does not need to be large and the input to the present invention can be a phonetic transcription of the desired speech. However, the phoneme is not a specific entity but rather specifies a logical representation of a group of speech sounds (allophones). During speech, the tongue, lips and teeth are in constant motion, gliding smoothly from one articulatory position to the next. This makes it virtually impossible to determine where an allophone stops and another begins. Thus interpolation becomes necessary because the vocal tract does not change shape abruptly. The sound segments which comprise the transition from the center of one phone (the acoustical representation of a phoneme) to the center of the next phone are known as diphones. If diphones are used as the segmentation method, the input is a phonetic transcription which relates to a synthetic lexicon. This insures that discontinuity does not arise between segments beginning and ending with the same phonemes. Consequently, the requirement for interpolation is minimized. In the preferred embodiment of the present invention, diphones are utilized as the units for concatenation. For the English language there are between 1,000 and 2,000 diphones as compared to the approximately 10,000 syllables. While diphones are the most commonly used concatenation units, in the preferred embodiment a modified diphone rather than a pure diphone strategy is used. Specifically, plosive-glide-vowel sequences (e.g., plae ) are implemented as single segments, sometimes referred to as "triphones", (e.g., "PLAE") rather than in two segments (e.g., "P#L# L#AE#) and stressed vowels are implemented as additional segments (e.g., "KAE1T" becomes "QXK# K#AE AE#1 AE#T T#QX").

To enhance the human-like quality of synthetic speech produced by the voice animator of the present invention, the voice editor provides the user with the ability to create and edit a prosody rule set to take account of the subtleties of intonation and rhythm for a particular language. While the prosodic features of a language are intrinsic to information content and serve primarily to allow speakers to express emotional or indicate relative importance of individual words, their fluctuations are also correlated with syntactic boundaries and provide important cues for sentence processing.

In the preferred embodiment, linear prediction coding (LPC) is utilized to encode the speech data derived from actual speech samples. Prior art methods of speech data representation typically utilize LPC to encode and store speech data. Short segments of sampled speech data (frames) comprising a substantial number of samples are converted to a linear filter model and a residual vocal tract excitation signal of the same length representing the airflow into the vocal tract. The airflow typically consists of fricative noise from the lungs and pulses from the glottis. For a 1/60 second (s) frame of sample data at 22 kHz containing 370 samples, the filter model is typically represented by 10 to 12 bytes of data and the residual excitation signal by another 370 bytes of data. It is known in the prior art that acceptable speech can be produced by reducing the residual excitation signal to a few simple parameters (e.g., energy level, voice/unvoiced indicators) which can be represented in 1 or 2 bytes of data. During resynthesis, the excitation is modelled by a noise generator and a pulse generator and prosodic variation can be introduced into the stored speech data. This method is very compact, but the airflow modeling techniques utilized yield low quality, mechanical sounding speech due to the fact that they are artificially generated as discussed hereinabove.

One advantage of LPC representation over noncoded sampled data representation is a reduction of the storage requirements. In the example given above, 370 data samples were compressed to 12 to 14 bytes, a substantial savings. Another advantage is that because the pitch and energy level of the synthesized speech is dependent on the vocal tract excitation, conventional speech synthesizers can vary the pitch and energy level of the original data by varying the artificially generated excitation to the filter models. This technique has been used successfully in the prior art to produce acceptable synthetic speech.

A major limitation of the prior art technique to encode speech data using LPC described elsewhere in this specification is that much of the speaker-dependent information contained in the residual excitation signal has been discarded. The residual excitation signal contains information about the speaker's lungs and glottis which is amplified by the speaker's vocal tract and contributes greatly to the individuality and identification of the speaker's voice. In one preferred embodiment of the present invention, an enhanced LPC data representation is used which stores the residual excitation signal rather than generating it artifically. This technique retains all of the advantages of the prior art LPC representation while minimizing the loss of speaker-dependent information from the residual excitation signal.

In the preferred embodiment, actual airflow noise is extracted from the prerecorded utterances and stored with the filter data. While this requires slightly more storage space, a much higher quality, human-like synthetic speech is provided having the sound and characteristics of a particular person.

The voice animator component of the present invention creates an animated voice speech output from an arbitrary text input utilizing the segment libraries and other data created and stored by the voice editor component. The automatic conversion of arbitrary text input to voice output involves two separate stages.

The first stage comprises converting the input text to a list of segments by decomposing the text into its equivalent phonetic features. This process may include some sort of normalization of the text. For example, abbreviations, punctuation marks, capital letters, numbers, etc. must be accommodated. Further, prosodic features such as rhythm, intonation, pitch, stress, etc. must be specified. The text is first converted to a phonetic representation utilizing the particular language's pronunciation rules. Prosodic variation is then added utilizing the defined prosodic rules. The segmentation rules for the particular segmentation scheme for the language are then used to convert the phonetic and prosodic representation to a list of segments and a description of each segment's prosodic environment.

The second stage comprises matching the list of segments thus obtained and producing speech output utilizing the available segments. The segment substitution rules are applied to replace missing segments with available ones. Each segment is converted from its LPC encoding to a standardized encoding blended to the previous segment and the resulting coded waveform coupled to a voice output device for decoding. The output device may be a speech synthesizer, another storage medium or a dynamic visual display such as a spectrogram. The voice animator also provides synchronization signals to external systems which may be synchronized with the system.

In addition to producing a text-to-speech output, the voice animator system can also produce output from any intermediate text representation (e.g., phonetic spelling) and can convey any text representation to any later text representation (e.g., text-to-segments). This capability allows the user to fine tune the output synthetic speech if desired. The output stage of the voice animator also provides a description of the segment processing and library mapping to provide a feedback loop for the editing process to allow the user to quickly identify and correct problems in the segmentation.

The segmentation data may be created and stored utilizing any desired encoding method. Plug-in modules including plug-in controller modules provide conversion algorithms to convert raw data including the prosodic environment to a speech segment in the standard representation utilized by the voice animator which can then be sent to the output device. Plug-in modules can also be utilized to provide additional processing and display features for the synthetic speechwave form created by the voice animator. Different data representations and encoding methods may be required to achieve different animation effects. For example, LPC is a flexible encoding method which provides a very natural, human-like voice quality whereas fast Fourier Transform techniques may be required to introduce interference and distortion in the frequency domain to obtain desired animation effects. Alternatively, uncoded recordings of the speech segments may be stored and utilized to achieve time domain effects.

The voice animation system of the present invention extends the animation paradigm so well-known in the visual world to the auditory realm. U.S. Pat. No. 4,884,972 issued to one of the inventors of the present invention and assigned to the assignee hereof on Dec. 5, 1989 and co-pending U.S. patent application Ser. No. 07/384,243 filed on Jul. 21, 1989 disclose synchronized speech visual animation systems which provide animated motion to a talking agent derived from the digitized image of a particular person, a digitized image provided by an artist or a combination of the two. The animation process breathes life or provides the appearance of life in an otherwise inanimate entity. In the present day, visually oriented world, animation is defined as a visual process. However, many prior art examples, "Porky Pig" and "Bugs Bunny", show that auditory aspects of animation are as significant as the visual aspects.

The voice animation system of the present invention provides a method of animation for mimicking an individual voice, creating new artificial voices or for combining the two. The voice animation system comprises an integration of many components, the speech sample library files and enhanced LPC speech data representations, for example, providing a new technological synergy resulting in the realization of auditory animation.

While the voice animation system of the present invention may be used alone in such applications as entertainment systems and speech therapy, the more general use is in conjunction with other systems such as an audiovisual animation system or data compression for voice mail and other messaging systems. Voice segment and prosodic data extracted from two or more voices may be combined to form a new human quality voice. Similarly, data could be processed to add desired characteristics to a specific human voice.

In conjunction with a visual animation system, lifelike talking agents can act as narrators to mechanical information systems providing a human oriented means of communication rather than a machine oriented means of communication. Further, a high quality voice makes an excellent user interface for the visually impaired when communicating with mechanical information systems. The voice animation system could be embodied in a prosthetic device which would allow a vocally impaired person to speak normally. Provided that sufficient recordings had been made prior to a person's speech becoming impaired that person could be provided with their own voice. Vocally impaired persons who had never been able to speak could have their choice of a voice for their prosthesis.

A related embodiment in the entertainment field provides an actor's voice when the actor has become unavailable. Previous recordings of the actor's voice could be segmented and reassembled for dubbing over the scenes where the voice is required.

BRIEF DESCRIPTION OF THE DRAWING

A fuller understanding of the present invention will become apparent from the following detailed description taken in conjunction with the accompanying drawing which forms a part of the specification and in which:

FIGS. 7*a*–7*i* are presentations illustrating the screen layout of various display screens corresponding to various procedures utilized in the voice editor shown in FIG. 4;

FIGS. 8*a*–8*g* are detailed presentations illustrating the display screen layout for various command menus utilized in the voice editor shown in FIG. 4;

DETAILED DESCRIPTION OF THE PREFERRED EMBODIMENT

Figure 1:
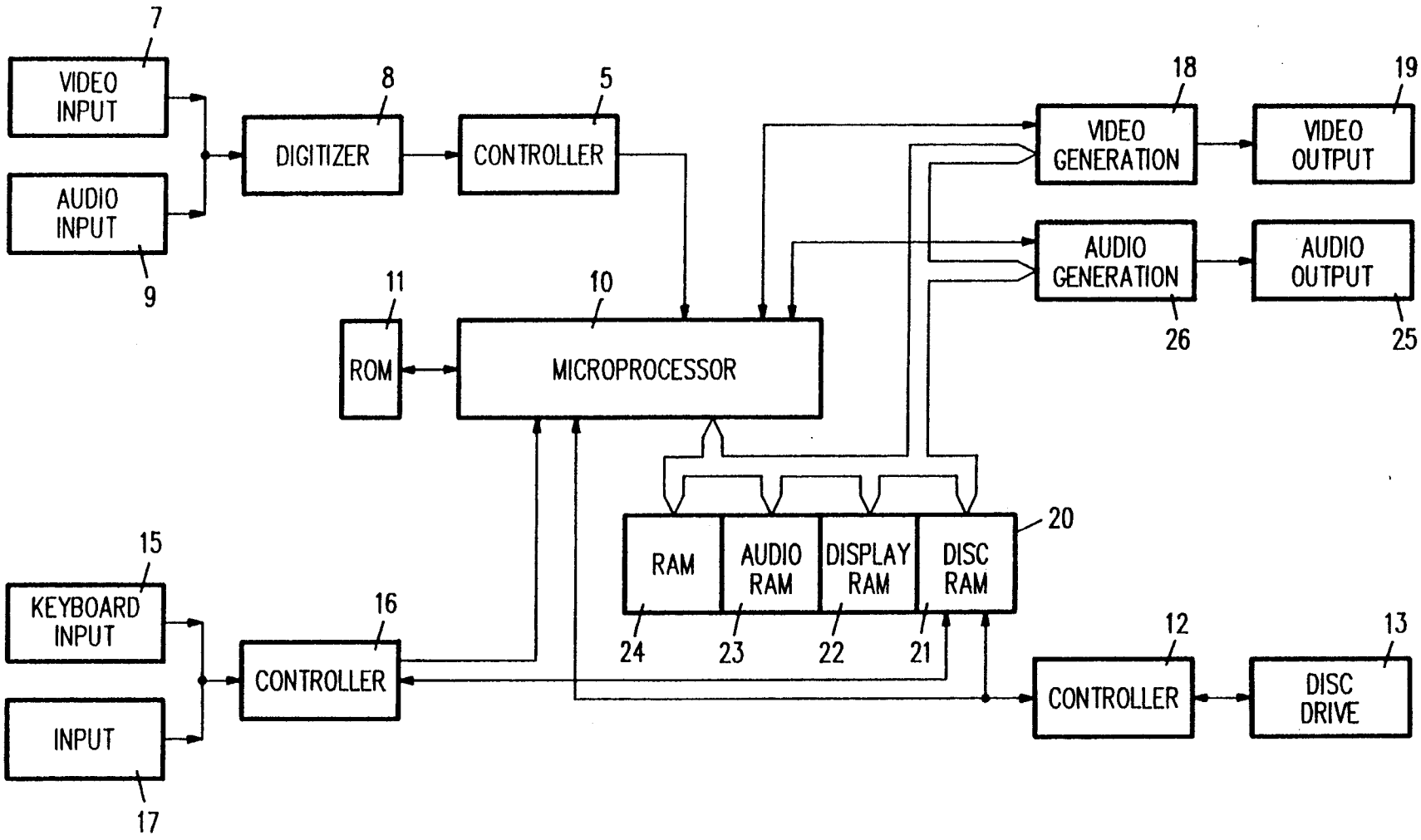
FIG. 1 is a block diagram of a microcomputer system implementing the voice animation system according to the principles of the present invention.

Referring now to FIG. 1, in one preferred embodiment of the present invention, a special-purpose minicomputer comprises a program controlled microprocessor 10 (a Motorola MC68030 microprocessor is suitable for this purpose), random-access memory (RAM) 20, read-only memory (ROM) 11, disk drive 13, video and audio input devices 7 and 9, user input devices such as keyboard 15 or other input devices 17 and output devices such as a monitor or video display 19 and audio output device 25. RAM 20 is divided into four blocks which are shared by the microprocessor 10 and the various input and output devices.

The video output device 19 may be any visual output device such as a conventional television set or CRT for a personal computer. The video output 19 and video generation 18 circuitry are controlled by the microprocessor 10 and share display RAM buffer space 22 to store and access memory-mapped video. The video generation circuits also provide a 60 Hz timing signal interrupt to the microprocessor 10.

Also sharing the audio RAM buffer space 23 with the microprocessor 10 is the audio generation circuitry 26 which drives the audio output device 25. Audio output device 25 may be a speaker or other kind of audio transducer, such as a vibrator to transmit to the hearing impaired.

Disk controller 12 shares the disc RAM 21 with the microprocessor 10 and provides for reads from, and optimally writes to, a suitable non-volatile mass storage medium, such as floppy disk drive 13. Disk drive 13 provides additional RAM space for special operating programs and applications. Disk storage would not be required in a host machine having sufficient RAM.

Input controller 16 for the keyboard 15 and other input devices 17 is coupled to the microprocessor 10 and also shares disc RAM 21 with the disc controller. This purpose may be served by a Synerted SY6522 versatile interface adapter. Input controller 16 also coordinates certain tasks among the various controllers and other microprocessor support circuitry (not shown). A pointing input device 17 such as a mouse or light pen is the preferred input device because it allows maximum interaction by the user. Keyboard 15 is an optional input device in the preferred embodiment, but in other embodiments may function as the pointing device, or be utilized by an instructor or programmer to create or modify instructional programs or set other adjustable parameters of the system. Other pointing and control input devices such as joy stick, a finger tip (in the case of a touch screen) or an eye-motion sensor are also suitable.

RAM 24 is the working memory of the microprocessor 10. The RAM 24 contains the system and applications programs and other information used by the microprocessor 10. Microprocessor 10 also accesses ROM 11 which is the system's permanent read-only memory. ROM 11 contains the operational routines and subroutines required by the microprocessor 10 operating system, such as the routines to facilitate disc and other output device I/O, graphics primitives and real time task management, etcetera. These routines are additionally supported by extensions and patches in RAM 24 and on disc.

Controller 5 is a serial communications controller such as a Zilog Z8530 SCC chip. Digitized samples of video and audio may be input into the system in this manner to provide characteristics for talking agents and synthesized speech. Digitizer 8 comprises an analog-to-digital converter (ADC) which serves as an audio digitizer and a video digitizer coupled to the video and audio inputs 7 and 9, respectively. Standard microphones, videocameras and VCRS will serve as input devices. These input devices are optional since digitized video and audio samples may be input into the system by keyboard 15 or disk drive 13 or may be resident in ROM 11.

Figure 2:
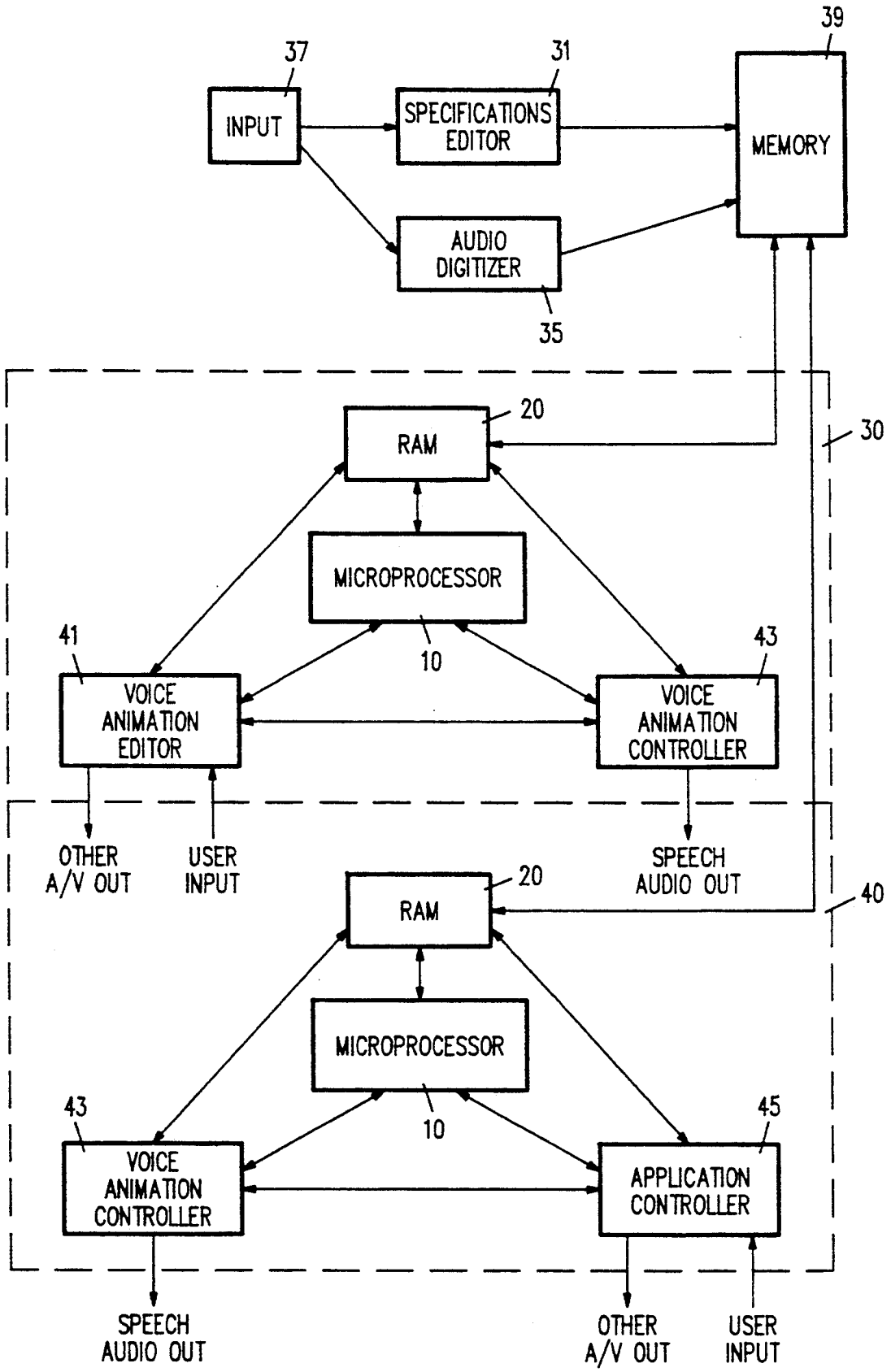
FIG. 2 is a conceptual block diagram illustrating the voice animation system as implemented in the system shown in FIG. 1.

Referring now also to FIG. 2, a conceptual block diagram of the voice animation system according to the principles of the present invention is shown. Prototype voice modeling data is input via various input devices 31. This data may comprise raw audio data, such as speech samples in the voice of a particular person, which is converted to digital data by the audio digitizer 8 or any other data, such as rule sets, etc., which is compiled by the specifications editor 37. The digital audio data is stored in associated files identified by the name of the audio source. The digital audio data is stored in associated files identified by the name of the particular speaker. The name of the speaker includes a code appended thereto indicating that the associated file contains raw digital audio data for the given speaker. Each file may contain several digital recordings, each recording identified by an utterance name. These files are catalogued in another file by the name of the associated speaker. The catalogue file also includes cross-references to associated language specification files and other files created by the system which store processed audio data and speaker-dependent information extracted by the system under operator control. These files are described in more detail with reference to FIG. 5a hereinbelow. Other program data including various specifications and rule sets for speech synthesis from plain text for a given language are stored in files identified by the name of the language.

To create a new voice animation model or to edit an existing model, the voice animation system is configured as shown in the voice editor box 30. The voice animation editor 41 allows the user to access voice audio data and language specifications via RAM 20 and display this data on a number of display screens via video output devices 19 which will be described below.

Using various tools provided by the screens, the voice animation editor 41 and the voice animation controller 43, the user is able to create a specific voice model and test it. The new voice model may be saved in an existing file or a new file, created for and identified by the name of the model. The microprocessor 10 provides coordination of the processes and control of the input and output (I/O) functions for the system.

When using a voice model, to provide random-access speech, for an animated face, for example, the voice animation system is configured as shown by the voice animator box 40. User input to the application controller 45 will call a selected voice model from a file in memory 39 via RAM 20. The voice animation controller 43 interprets script, i.e., text, input via the application controller 45 and provides the appropriate instructions for the audio output and the microprocessor 10. Similarly, as during the create and test process, the microprocessor 10 provides control and coordination of the processes and I/O functions for the voice animation system.

Figure 3:
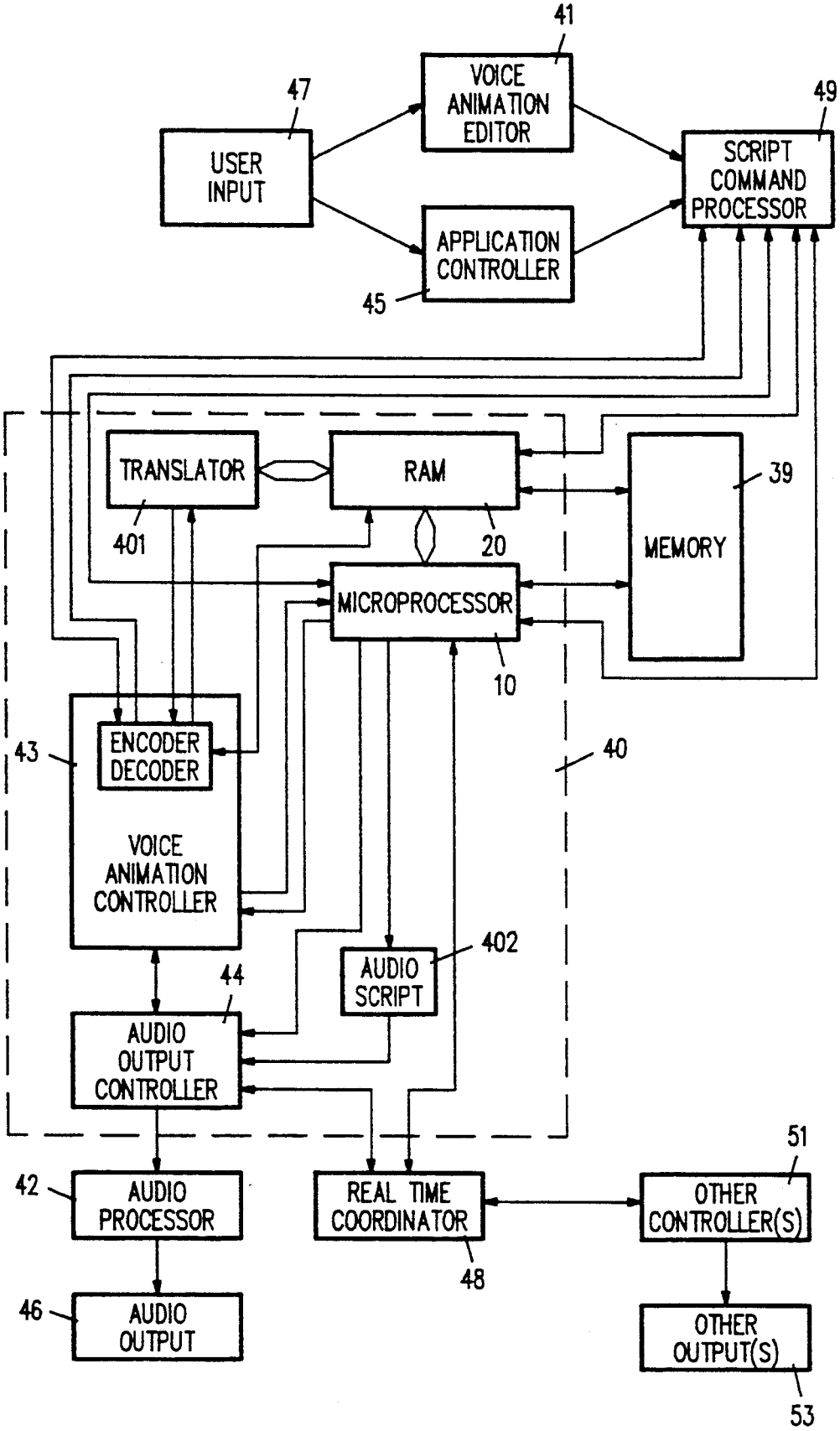
FIG. 3 is a functional block diagram illustrating the major data flow and processes for the system shown in FIG. 2.

The voice animation controller 43 (also referred to as the voice animator) interprets input commands from a user, from prestored scripts or from instructions generated by another program, such as an artificial intelligence program, via the applications controller 45 and provides the appropriate instructions for the audio output controller 44 (as shown in FIG. 3). These instructions direct the audio output controller 44 to retrieve sampled audio data from associated files for output processing. In one preferred embodiment, the processed audio data is coupled to a loudspeaker via a digital-to-analog converter (DAC) to provide sound. In other preferred embodiments, the processed audio data may be stored for later processing, such as for display in a spectrogram via the video output 19.

Referring now also to FIG. 3, a functional block diagram illustrating the major data flows, processes and events required to provide voice animation and synchronize it with an external controller is shown. The voice animation system comprises the voice animation editor 41, the application controller 45, the script command processor 49 and associated user input devices 47 and is interfaced with the voice animation controller 43 at the script command processor 49. In response to a user input, the application controller 45 or the voice editor 41 calls on the microprocessor 10 to fetch from a file in memory 39 the audio data for a particular voice model. This data in turn instructs the microprocessor 10 to fetch from a file in memory 39 the specifications for converting user input into speech audio output. As required by user input, the microprocessor 10 will initiate the voice animation process and synchronize it with other output controllers. Although both the voice animation editor 41 and the application controller 45 access the script command processor 49, the normal mode of operation is for a user to utilize the voice animation editor 41 to create and edit a voice model and, at a subsequent time, utilize the application controller 45 to call up a voice model for use, either alone or coordinated with a particular application. The voice animation controller 43 is also used during the creation and editing processes to provide an audio test capability. The speech output controller provides a synthesized speech output signal which corresponds to a text input and may be coupled to any desired output device. For example, the speech output signal can be coupled to an audio processor 42 and audio output devices to produce audible animated speech corresponding to the input text or the speech output signal may be coupled to other controllers and output devices via a relative coordinator 48 or stored for any desired use at a later time.

Figure 4:
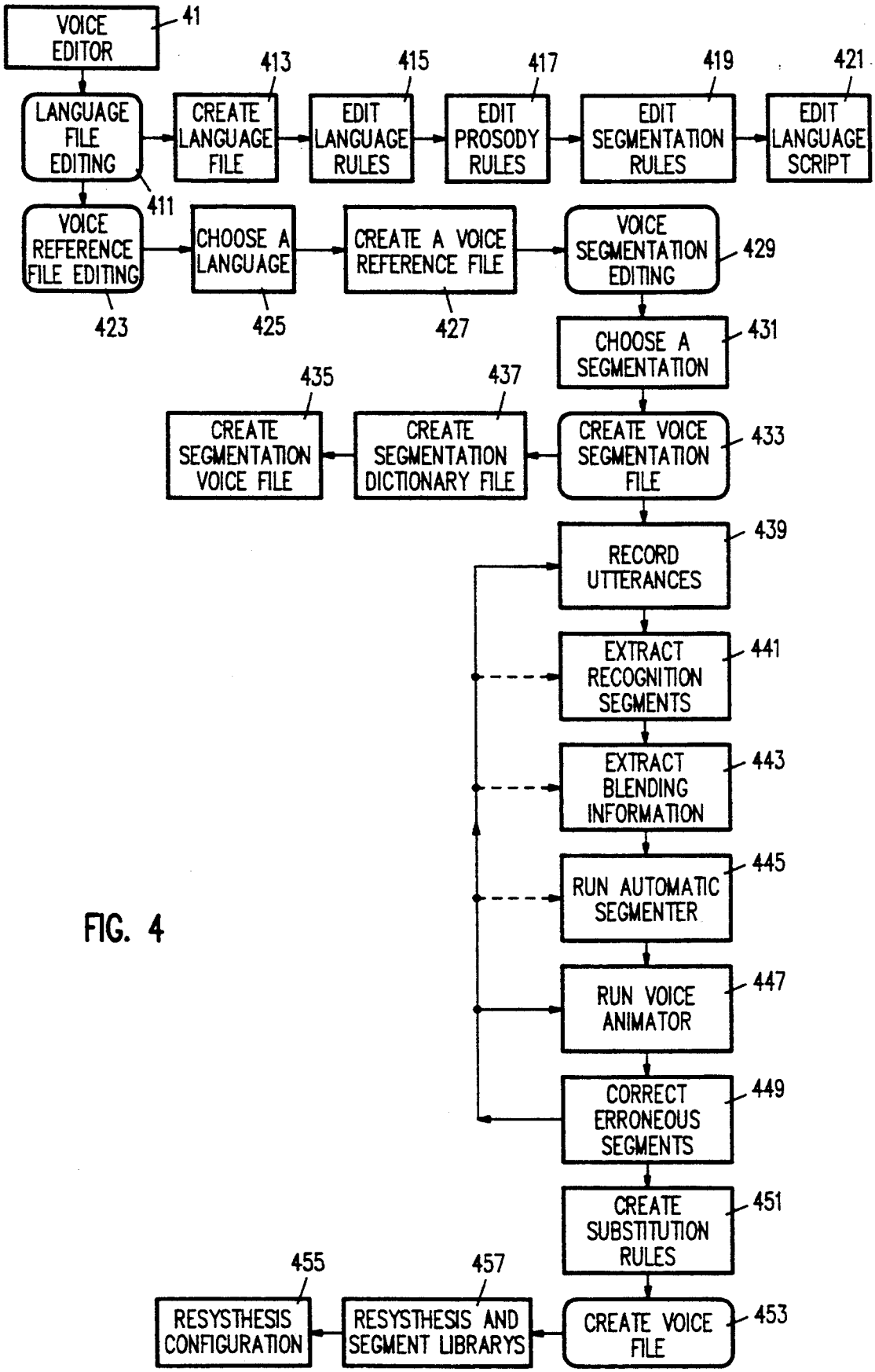
FIG. 4 is a conceptual block diagram illustrating a flow chart for the process and control of the voice editor of the present invention.

Referring now also to FIG. 4, a flow chart diagraming the processes and command flow in the preferred embodiment of the voice editor 41 (also referred to as the voice animation controller) is shown. Before a particular voice can be recorded and segmented, a language file 411 must be specified for each language in which it is desired to provide synthetic speech for a voice. An empty language file 413 for each language to be specified is created and identified by the name of the language described. Then the various rule sets required, text to phonetics rules 415, prosody rules 417 and segmentation rules 419 for the language described are created in the order shown. While this order is not important, it reflects the natural dependencies among the various rule sets. To create the rule sets, the text to phonetic rule set, for example, a universal rule set is created and stored in memory 39 and then retrieved and edited to provide the rule set for the specific language file being created. An empty set of text to phonetics rules 415 is added to the file and labeled with the name of the language that it represents. An empty set of prosody rules 417 are also created and labelled. The operator can then edit these two rule sets so that the voice animator 43 can correctly translate input text into a phonetic representation of the language, complete with prosodic information. When the phonetic representation of the language has been defined by rule sets 415 and 417, the operator can define any number of segmentation rules sets 419 identified by the name of the appropriate segmentation scheme to instruct the voice animator to convert the single phonetic representation for the desired language into a list of segment names and prosody variation commands for the voice animator 43 to use in the animation process. Because the voice animator 43 must be able to change languages, voices and segments, a configuration script for the voice animator is also created and then modified or edited to provide a language configuration script 421 to allow the voice animator 43 to access the language being specified. Typically, the configuration script 421 provides instructions for the voice animator 43 to utilize a specific segmentation scheme. Other embodiments may use the configuration script 41 to provide voice animator instructions related to other aspects of the specified language required for a particular embodiment.

The voice reference file 423 is created 427 for each voice and includes a file of the extracted speech segments and a speech segment dictionary file as well as a file of the recorded speech utterances from which the speech segments were taken. Each voice reference file 423 is associated with a particular language 425. If it is desired to synthesize speech for a particular voice in several different languages then a voice reference file 423 must be created for each desired language for that voice. First an empty voice reference file 427 is created. A voice segmentation process 429 utilizes the language specific segmentation rules 419 created when the language file 411 was created. The voice segmentation process includes steps 431, 433 and 439–453 as shown. The flow diagram shows the typical order, although many of the steps may be completed out of turn. For example, recording 439 of speech samples or utterances may be made at any time and the automatic segmentation algorithms 445 can be rerun on an entire recorded library at anytime. The voice animator 43 may be utilized at any time 447 to verify segment data and correct erroneous segments 449. As the segmentation process proceeds, a segmentation voice file 435 storing the speech segments for a selected segmentation scheme and a corresponding segmentation dictionary file 437 cross-referencing the speech segments to the speech utterance they were extracted from are created and a reference to the two files is stored in a voice segmentation file 443 and are identified by the name of the segmentation. A set of segment substitution rules 451 is created to substitute existing speech segments for missing speech segments. Encoded resynthesis and speech data 457 and a resynthesis configuration script 455 for the voice animator for the particular voice 455 are created and stored in a voice file 453 which forms a part of the segmentation voice file 433. All of the extracted speech segments for that particular voice are stored in the segmentation voice file 435 while the segmentation dictionary file 437 contains a dictionary mapping each extracted segment to its source speech utterance.

Figure 5A:
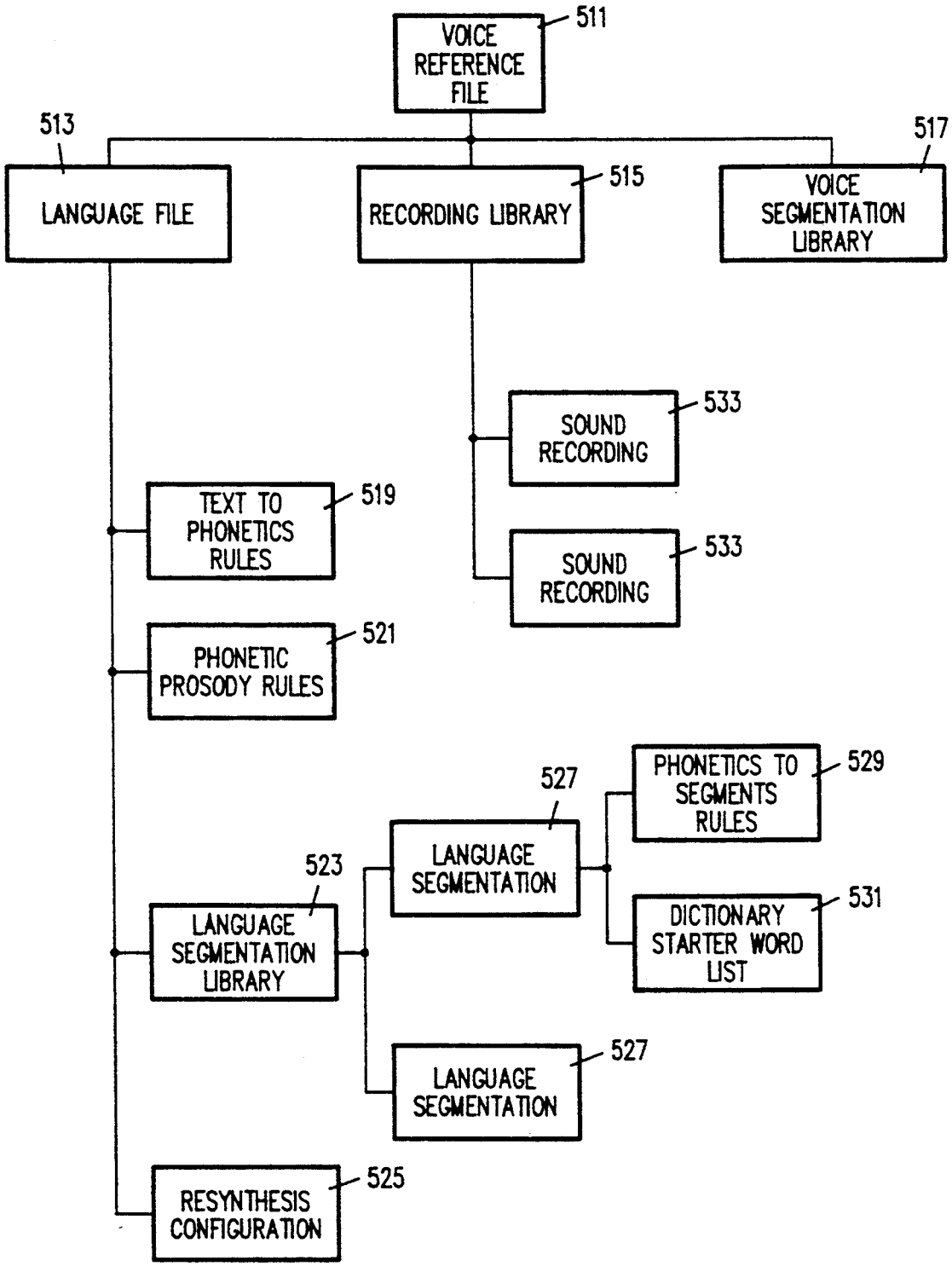
FIGS. 5*a*–5*h* are block diagrams illustrating the various data structures utilized by the voice editor shown in FIG. 4.

Referring now to FIGS. 5a–5h, the data structures and file architecture used by the voice editor 41 are shown. The voice editor 41 includes a voice reference file 511 corresponding to each voice which is recorded and modeled. A separate voice reference file 511 is required for each language that a particular voice will be synthetically generated in. FIG. 5a diagrams the structure of the voice reference file 511. The voice reference file 511 comprises a language file 513, a recording library 515 and a voice segmentation library 517 created as described above with reference to FIG. 4.

The language file 513 includes a set of rules 519 to convert the language's written text representation to a phonetic representation unique to the language and a set of rules 521 for adding prosody to the phonetic representation. The language segmentation library 523 includes one or more language segmentation plans 527. Each language segmentation includes a rule set 529 for converting a phonetic representation with prosody to a list of segments and their associated prosodic environments, and a starter work list 531 for creating a dictionary that contains all of the speech segments for the language. In the preferred embodiment, this list is maintained outside the language file 513. The resynthesis configuration file 525 contains a set of instructions for reconfigurating the voice animator 43 for that language after opening the language file 513. The language file 513 also includes a resynthesis configuration file 525 which provides various parameters and data to reconfigure the voice animator 43 for the particular language to be utilized. In the preferred embodiment, only one language file 513 for each language to be used is created and is accessed or showed by all of the voice reference files for that language.

The voice reference file recording library 515 contains an indexed list of zero or more recorded speech samples or utterances which can be retrieved and played back by the voice editor 41 or the voice animator 43. In the preferred embodiment, the recordings are stored in a number of files 533 containing approximately 10 to 20 recordings per file. Other embodiments could store the recordings in a single file or in mass storage media, such as magnetic audio recording tape or compact video discs.

Figure 5B:
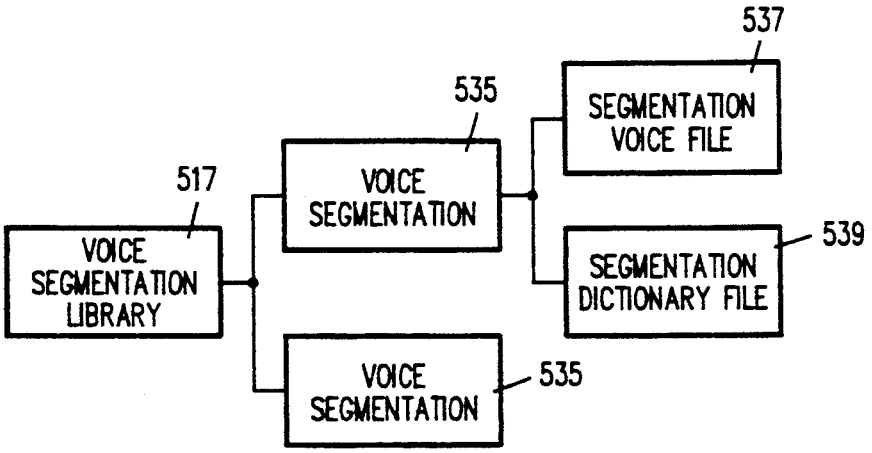

FIG. 5b diagrams the structure of a voice segmentation library 517 belonging to the voice reference file 511. The library is an indexed list of one or more voice segmentation schemes 535, each of which must correspond to a language segmentation in the language file associated with the voice reference file. For each voice segmentation file 535, a segmentation voice file 537 and a segmentation dictionary file 539 is formed.

Figure 5C:
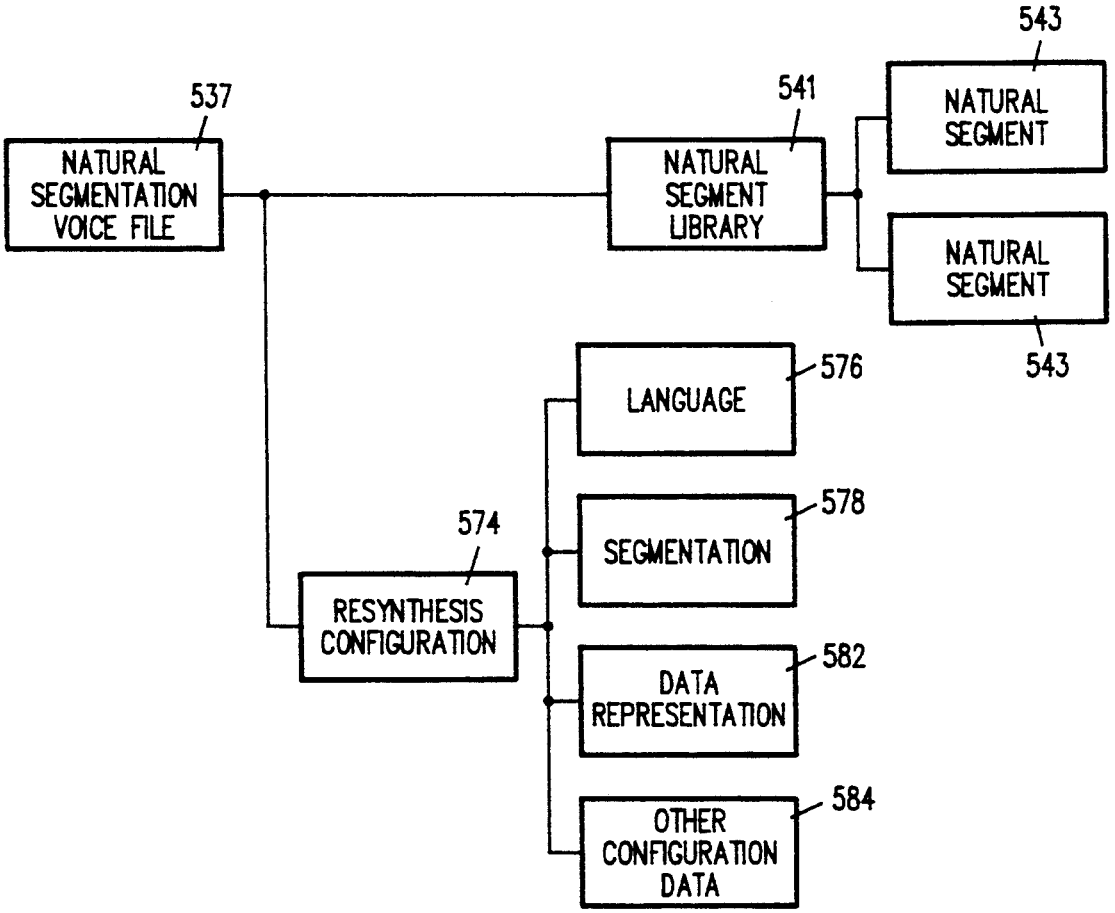

FIG. 5c diagrams the structure of a segmentation voice file 537. The segment library 541 is an indexed list of zero or more extracted speech segments 543. The resynthesis configuration 574 includes a language reference 576 indicating the language that the segments 543 were extracted from, a segmentation reference 578 indicating which segmentation rules or scheme for the language was used in the extraction and a data representation 582 indicating that the segment data is stored in and the type encoding utilized. Other configuration data 584 is included as required for the particular language 576 and data format for the particular segmentation voice file. The synthesis configuration 574 provides the required parameters and rule references which allows the segmentation voice file 537 to be used directly by the voice animation controller 45 during the operation of the voice editor. The file structure shown is for a "natural" data format, the stored voice data being simple digitized audio and does not include any residual breath noise.

Figure 5D:
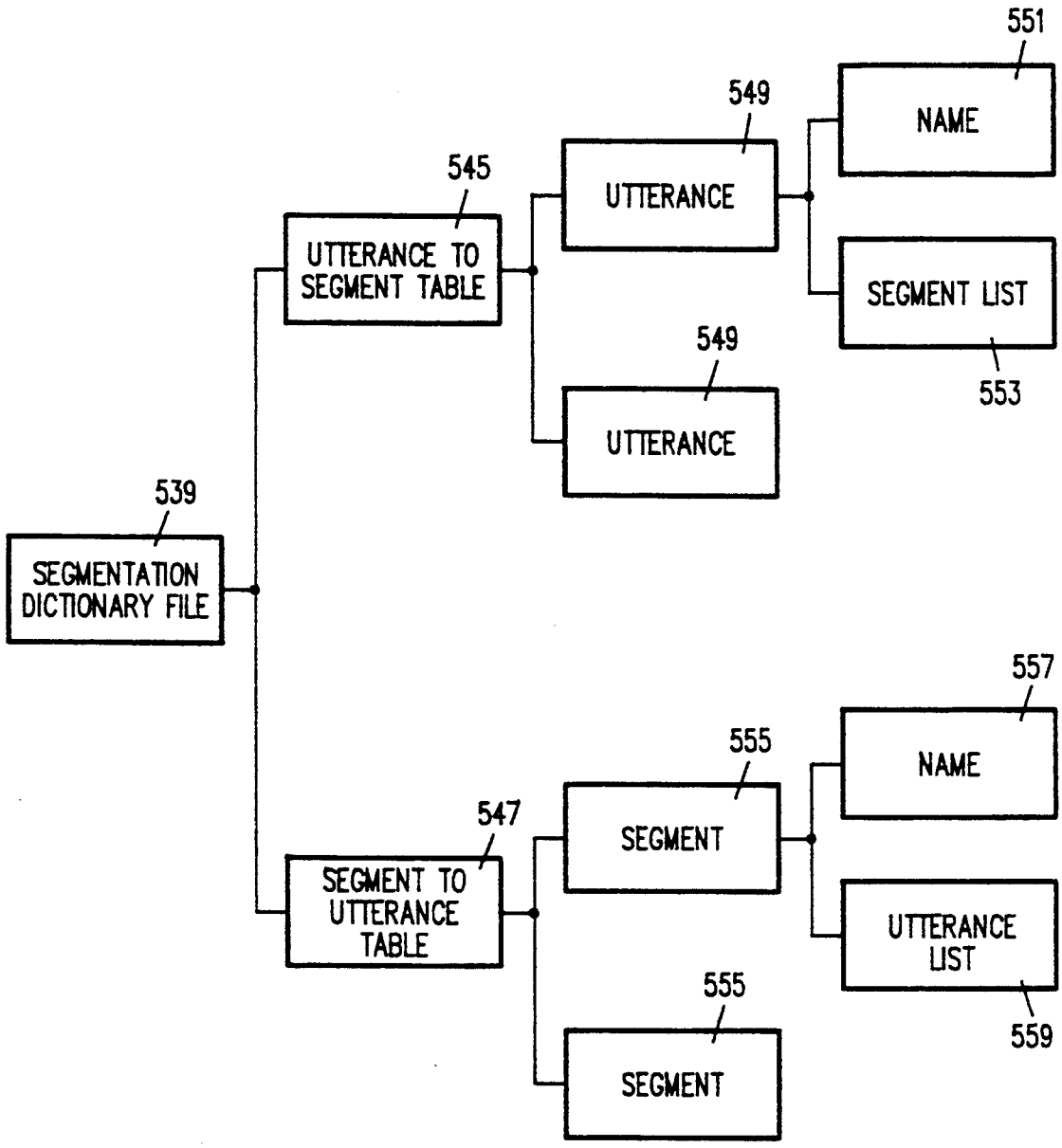

FIG. 5*d* diagrams the structure of a typical segmentation dictionary file 539. It consists of two lookup tables 545 and 547, one table 545 of which associates recorded utterances 549 having the names 551 with the segments 553. Similarly, the other table 547 associates segments 555 having names 557 with the recorded utterances 559 that contain them. The rationale for the dictionary file 539 is to provide the operator with (1) a complete set of segments 555 for the entire language; (2) utterances 557, 559 that contain these segments 555; and (3) the ability to correct such information to reflect speaker-dependent pronunciation.

Figure 5E:
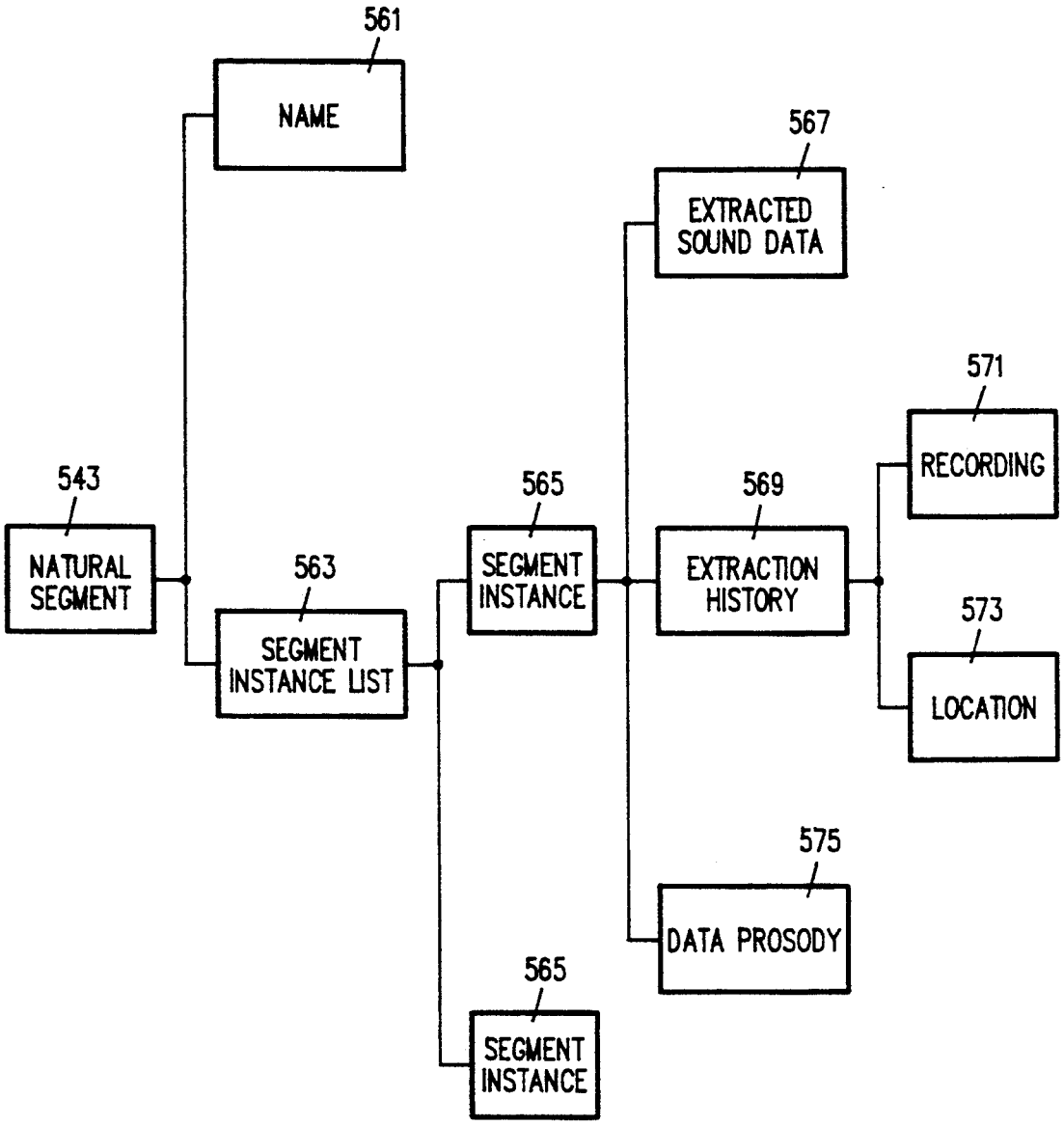

FIG. 5*e* illustrates the data structure of a speech segment 543 stored in a natural format (digitized speech) in a segmentation voice file 537. Each segment 543 is named 561 and stored as a list 563 of one or more instances of that segment 543 reflecting different prosodic environments that the segment was extracted from including the associated extracted sound data 567, its extraction history 569 and prosody data 575. The extraction history record 569 of a segment indicates which recording 571 the sample was extracted from, e.g., "cat", and the location 573 in that recording, e.g., samples 2655 through 5197.

Figure 5F:
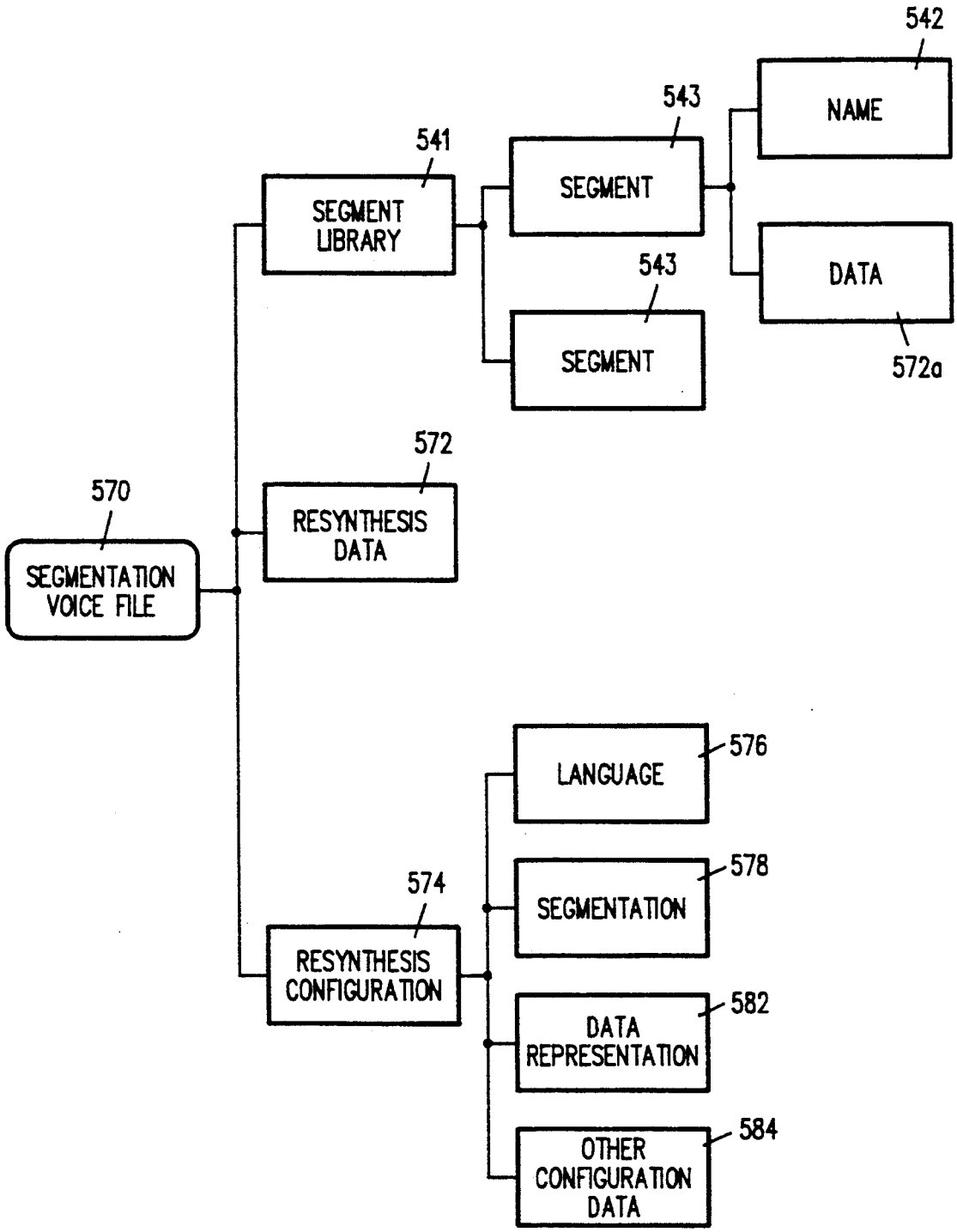

FIG. 5*f* illustrates the structure of a generalized segmentation voice file 570. The segment library 541 is an indexed list of zero or more processed speech segments. The resynthesis data 572 is optionally any other data that may be needed for processing the segments into the standard output format used by the voice animator and may include residual breath noise (as shown in FIG. 5*h*). The resynthesis configuration must indicate the language, segmentation and data representation to be used with the voice file. A particular embodiment can dictate the need for other configuration information.

There are at least two kinds of voice file data representations: the natural representation and the enhanced filter model representation (LPC encoding). The natural representation is defined for segmentation voice file 537 (as shown in FIG. 5*b*) and has the same segment library as a voice segmentation file and no resynthesis data.

Referring now also to FIGS. 6*a*–6*d*, after a speech frame 601 has been decomposed into LPC parameters and the residual excitation signal by prior art methods, the residual signal 603 is examined for glottal pulses 605 using well-known prior art methods of pulse detection. When a pulse 605 is detected, it is precisely located using an energy peak detector with a fixed-length window in the pulse area 605, copied to a library of pulses and the adjacent stationary breath noise is copied into its location in the residual excitation signal. When all the pulses 605 have been removed, the resulting signal 607 is a sample of standard breath noise from the speaker with a given energy level which is copied into another library. Other embodiments might use other methods for the extraction of the glottal pulses 605. During resynthesis, rather than using synthetic pulse and noise generators to excite the filter, a signal of the appropriate energy and pitch is created by summing residual breath noise from the breath noise library and a pulse train made up of pulses from the glottal pulse library. The resulting speech has the full prosodic variation of prior art LPC methods but with much of the speaker-dependent excitation information.

The method described above provides natural speech, but requires more storage than artificially generated excitation data. Storage reduction can be accomplished by retaining only a fraction of the pulse and breath libraries. A system highly constrained by space might only retain 120 breath noise frames and 60 glottal pulses, at maximum energy, and vary the energy by varying the excitation signal gain giving storage performance comparable to prior art with significant quality gains. Since LPC is a linear model of a nonlinear system (the human vocal tract), the nonlinear information is retained in the residual excitation, thus storing larger libraries of this residual excitation will increase the naturalness of the speech produced. For example, a system with more storage might use the same amount of data as the previous example for each phoneme, or even store the entire library to give the maximum naturalness. Nevertheless, with only a few samples in each library, the advantage over prior art are readily apparent. One must, however, take care not to reduce the libraries beyond the point where the similarities of the excitation signal are audible. Two seconds of data should be sufficient to fool most listeners.

Another enhancement allowed by this data representation relates to the production of plosives or bursts known as stops. Stops are extremely nonlinear events and are not modelled well by LPC. In one preferred embodiment, frames containing stops are identified by labelling and their residuals excitations can be stored separately in a third library, allowing them to be reproduced perfectly. This does not lead to a great increase in storage requirements because the number of stop frames for stops necessary in a library sufficient to mimic a speaker is small compared to the total number of frames. Even so, a subset of these excitations could be stored (one or more per stop) rather than all of them, giving storage requirements again comparable to prior art LPC storage requirements but with superior stop-modelling capabilities.

Figure 5G:
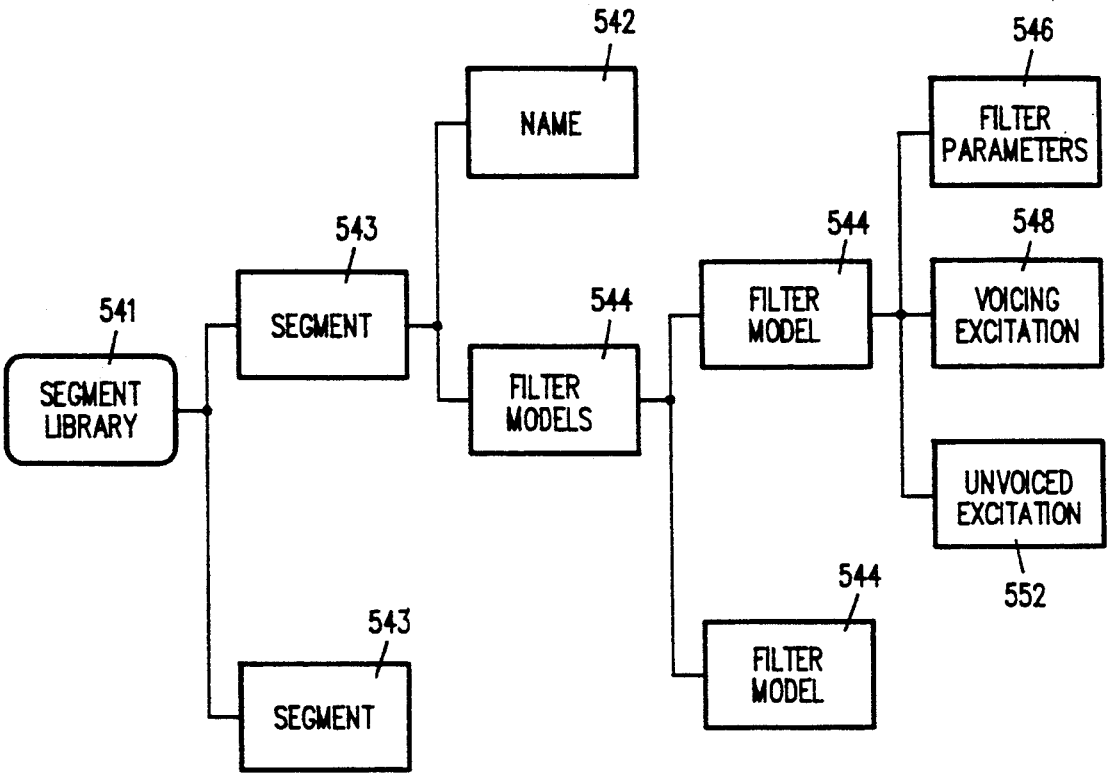
Figure 5H:
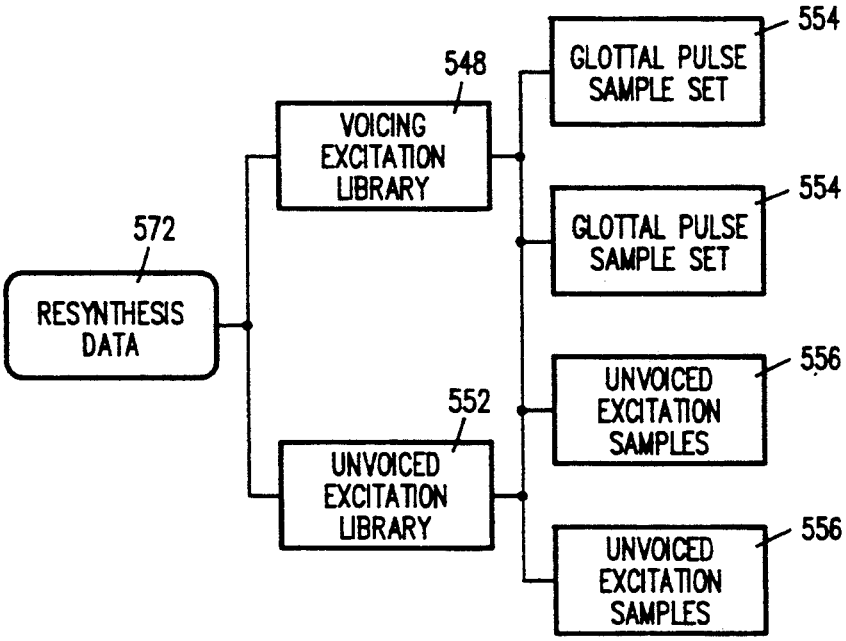
Figure 6A:
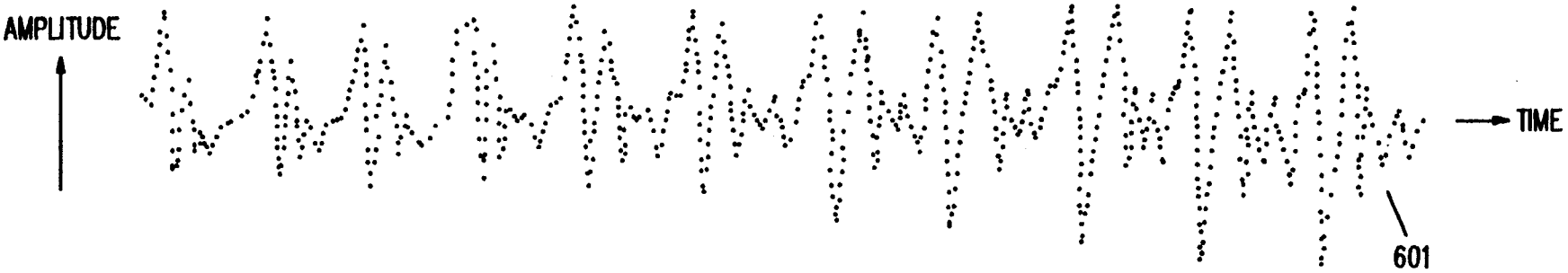
FIGS. 6*a*–6*d* are a waveform display of a segment of the word "call" sampled at 11 khz illustrating the extraction of the speech, glottal pulses and residual breath noise data according to the principles of the present invention.
Figure 6B:
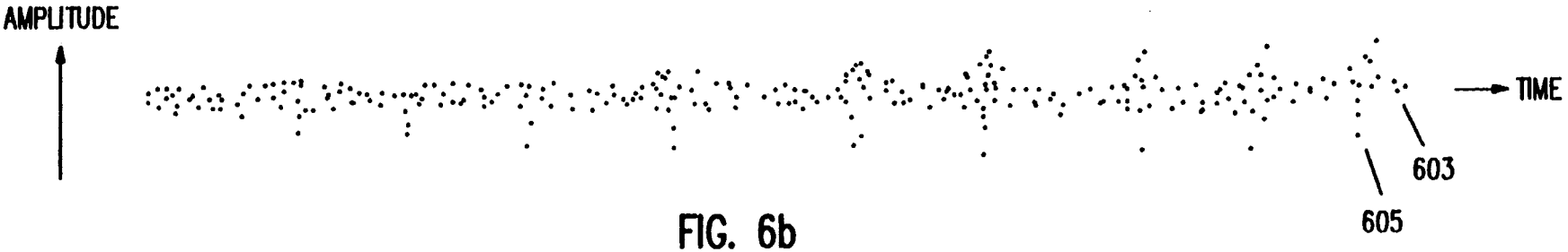
Figure 6C:
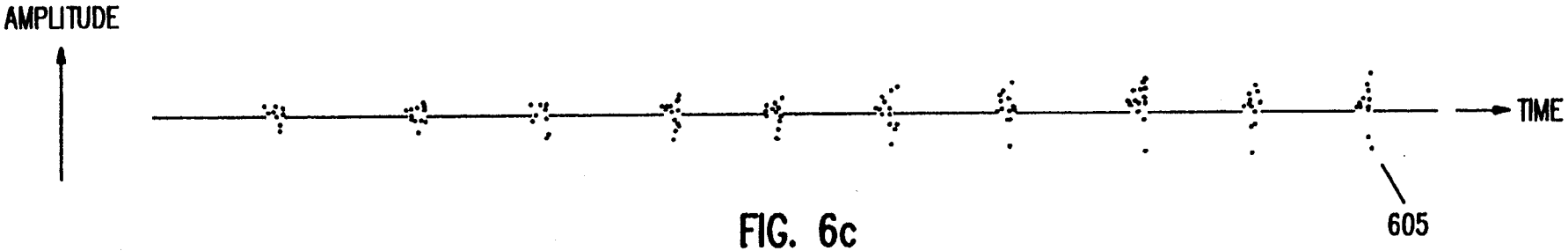
Figure 6D:
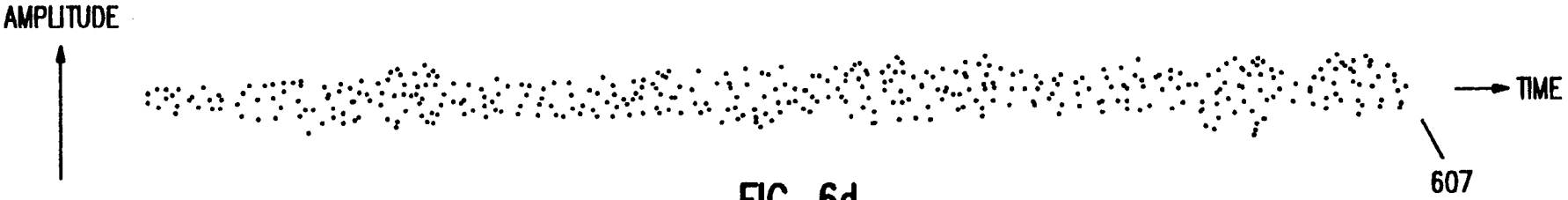
Figure 7B:
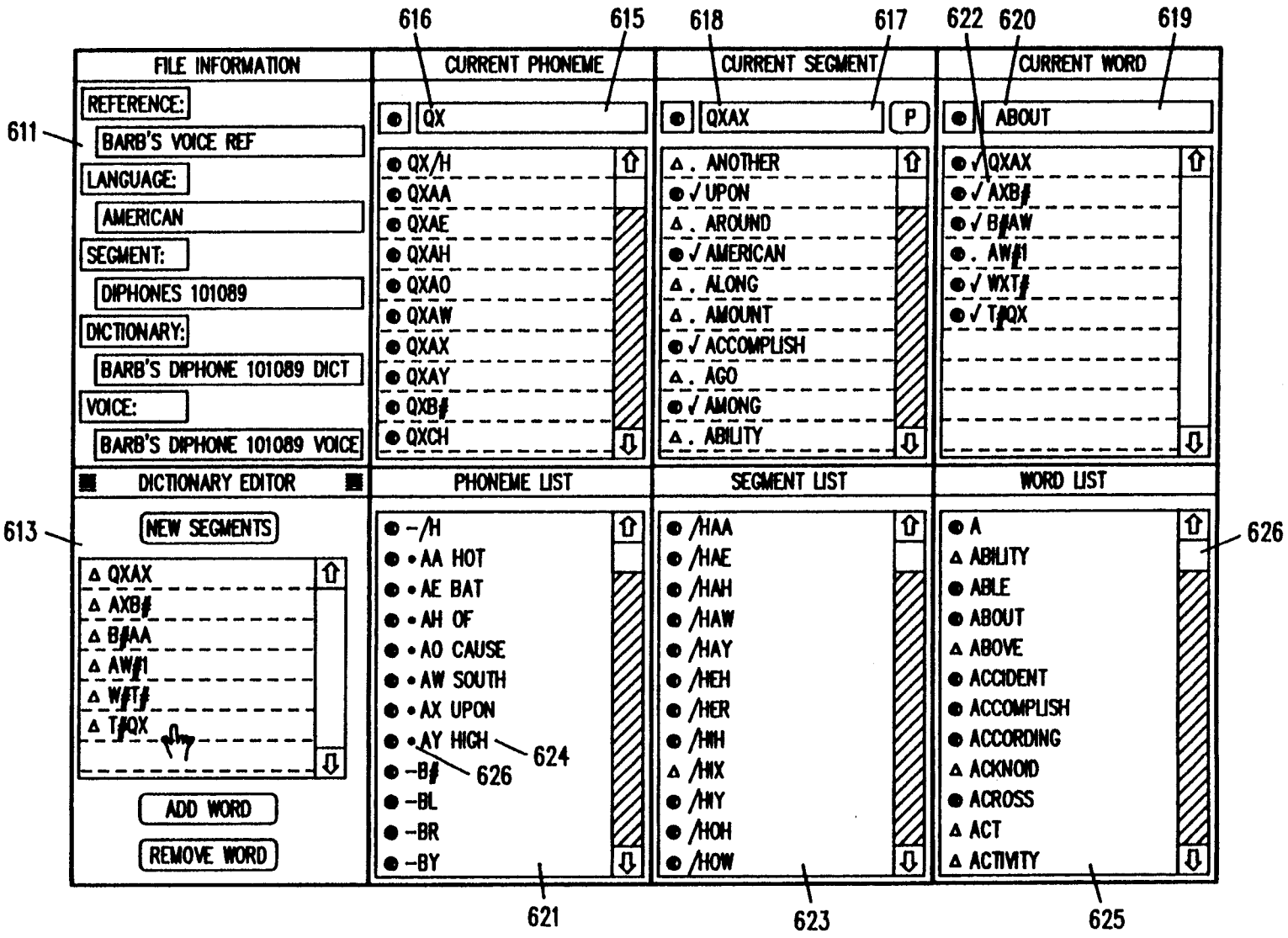
Figure 7E:
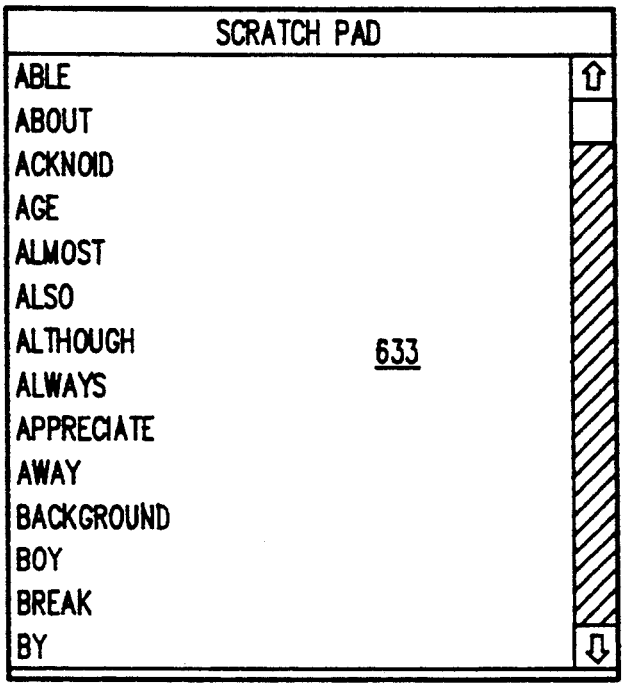
Figure 7F:
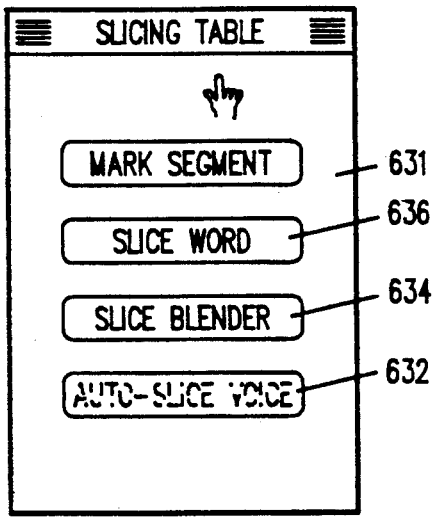
Figure 7G:
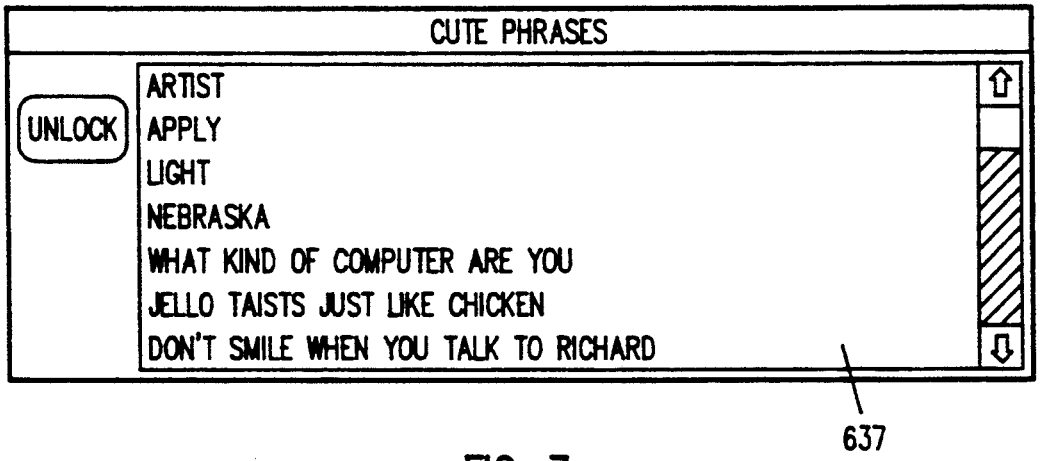
Figure 7H:
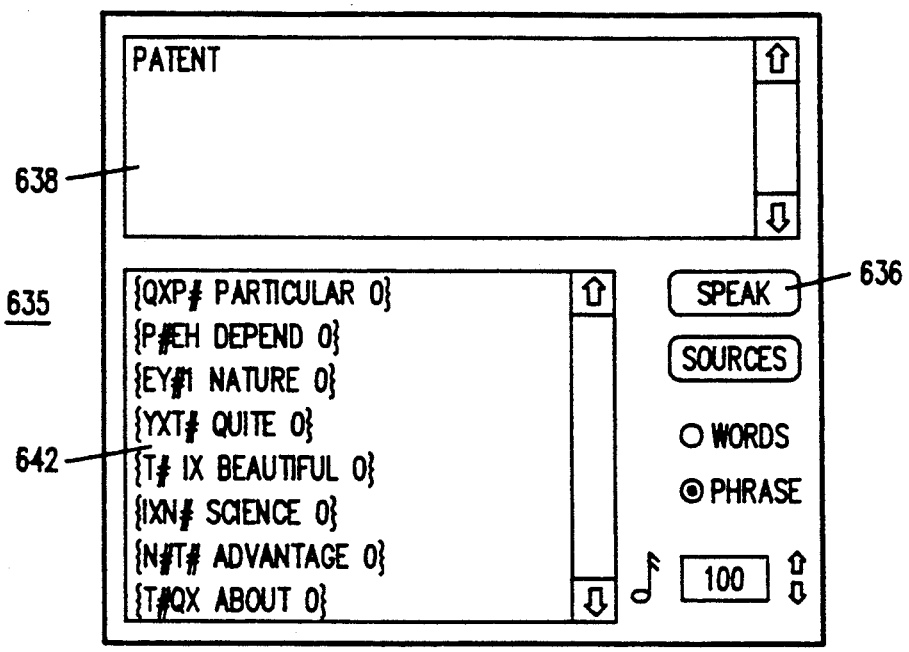
Figure 7I:
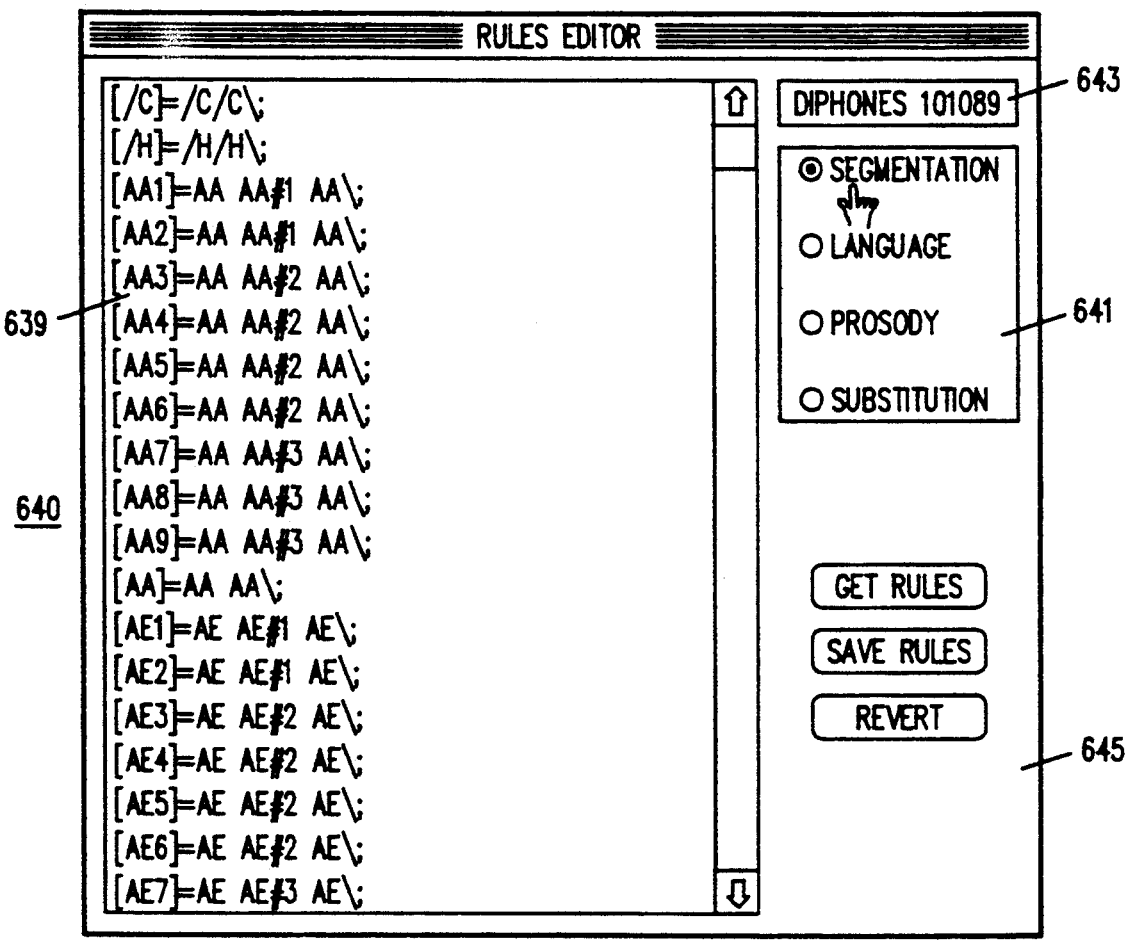

FIG. 5*g* illustrates the segment library 541 structure for the enhanced filter model representation. The data for each segment 543 is encoded as a sequence of filter model frames 544 identified by the segment name 542, 543 and specifications providing instructions and coding to create the filter excitation from the resynthesis data. In the preferred embodiment, the model used is a 10 parameter AR-lattice using data sampled at 11 kHz and updated every 1/60 second (s). The segments are formatted with 10 bytes representing the filter lattice coefficients 546, 1 byte identifying the pulse library 548 to provide the excitation's glottal pulses and 1 byte representing the background sample 552 to superimpose these glottal pulses on. Other embodiments might represent the data differently. For example, an ARMA lattice model could be used to provide an improved nasal model. Alternatively, the original excitation signal with the glottal pulses extracted could be stored with each filter frame, giving more excitation at the cost of higher storage requirements.

FIG. 5*h* illustrates the structure of the resynthesis data 572 for the enhanced filter model representation. The voicing excitation library 548 contains one or more sets of glottal pulses 554. Each set of glottal pulses 554 contains one or more glottal pulses that can be used when specified by a segment's filter model frame. In the preferred embodiment, there is one set of 50–100 pulses for each voiced phoneme. Other embodiments could use a single library or possibly one library for nasals and one for non-nasal voice speech. The unvoiced excitation library 552 contains one or more sets of unvoiced speech excitations 556. The preferred embodiments stores 50 to 100 milliseconds (ms) of unvoiced speech excitation noise per phoneme. Other embodiments might store only voiced and unvoiced excitation noise.

Appendix A attached hereto is a MC68030 assembly listing that implements a one-multiply per stage LPC lattice filter. This filter is used for creating synthetic speech from the preferred embodiment's LPC filter model data representation. On a MC68030 clocked at 16 MHz, this code will convert the passed residual signal sampled at 11 kHz to a sampled speech signal using the passed lattice parameters in 50% of real-time.

Referring now to FIGS. *7a–7i*, in the preferred embodiment, the voice animation system of the present invention is used in conjunction with the minicomputer system shown in FIG. 1 (a desktop personal computer comprising sufficient memory and an appropriate microprocessor including an audio chip may be programmed to implement the present invention). A number of screens or windows selected from a system menu are displayed on the system monitor 19 to facilitate use of the system. Input to the system for performing the various functions, creating the different files and the text-to-speech speech synthesis is via the system keyboard 15 and a mouse 17. Audio input for recording the speech samples or utterances is via the audio input 9 which may be a microphone for recording the audio directly or other suitable means such as a plug-in module of prerecorded speech samples.

FIG. *7a* illustrates a list 609 of windows for use with the voice editor 41. The various windows and lists required for a particular voice editor operation are called up or fetched from the voice editor list 609.

FIG. *7b* illustrates the file information window 611, the dictionary editor window 613 and various lists associated with these windows. The dictionary editor 613 contains a field 612 and controls 614 used for modifying words in the segmentation dictionary. The current phoneme window 615 displays a phoneme 616 and all the segments from the segmentation dictionary file 539 that begin with the current phoneme 616. The phoneme list window 621 displays all the phonemes and their status in the automatic segmentation process (automatic segmenter 445 as shown in FIG. 4). The phoneme list 621 includes the word 624 (in the case of the phonemes shown with an adjacent bullet 626) from which the associated phoneme was extracted. The current phoneme 616 is selected from the phoneme list 621. The current segment window 617 displays a segment 618 from the segmentation dictionary file 539 and the words that contain the current segment 618. The current word window 619 displays a word 620 from the segmentation dictionary file 539 and the segments 622 that the current word contains. The word list window 625 contains a list of the words in the segmentation dictionary file 539. The different lists can be scrolled up or down utilizing the control 626 at the side of each window.

FIGS. *7c* and *7d* illustrate the recording studio window 627 and the recorder window 629. The recording studio window 627 contains controls for recording speech samples, the current word 620 displayed in the current word window 619, for example. Other embodiments might record utterances instead of words. Moreover, other embodiments may provide for recording of a word without reference to a dictionary. The recorder window 629 contains controls for using the analog to digital converter 8 (digitizer 8, as shown in FIG. 1) Other embodiments could use other means for recording utterances.

FIGS. *7e–7g* illustrate a slicing table control window 631 cute phases window 637 and a scratch pad 633. The slicing table window 631 contains controls and displays for extracting segments from a recording. The slicing table window 631 also includes controls for extracting information used by the automatic segmenter and for manually determining the prosodic environment of segments. These last two sets of controls may be different or even omitted in a different embodiment. Appendix B attached hereto illustrates a C code fragment from the preferred embodiment of the editor command processor. This code extracts a specified piece of the passed digitized sample and is used to extract segments from recordings.

The scratch pad window 633 is a place where the operator can store information and can be used to provide data for various batch mode operations. Additional storage facilities are provided such as a "cute phrases" table 637 for storing text. The cute phrases window 637 provides storage for test phrases that can be accessed by the voice animator 43.

FIG. *7h* illustrates the voice animator window 638 which provides controls 636 for using the voice animator to detect erroneous segments. An important feature of the voice animation system is the ability of the voice animator 43 to provide feedback information to the voice editor 41 related to the generation of the voice animator 43 output. This feedback loop is an important efficiency tool. Since the voice animator 43 can be instructed to provide stored data instead of audio output, the voice animator window 638 could be enhanced in another embodiment to display the output for detailed inspection, rather than simply producing audio output utilizing the speak button 636. The voice animator window 635 is used to create synthetic speech from existing file data and allows user verification. The user types in the desired word or phrase in the text field 638 and the voice animator controller 43 will audibly recite it when the speak button 636 is pressed. After reciting the text, the voice animator controller 43 returns a list 642 of segments used to create the recited speech corresponding to the typed text. This allows the user to rapidly track down segments that do not blend well and correct or smooth the blending to provide a higher quality or more desired speech. The segments are listed by name, with the word they came from and from which occurrence within the word ("0" being the first occurrence).

FIG. *7i* illustrates the rules editor window 640 which provides fields 641 and controls 645 for editing segmentation rule sets 639. In the preferred embodiment a single rule format is used for all rule sets. Other embodiments could have separate formats for each type of rule set or even for each rule set. The rules editor is illustrated and is used to edit a set of segmentation rules 639 called "diphones 101089". The segmentation, language, prosody and substitution buttons 641 toggle between the various kinds of rules that can be edited. The field 643 immediately above these buttons displays the name of the rule set being edited. The bottom set of three buttons 645 are for saving and accessing rule sets.

Appendix C is a list of commands sufficient for implementation of embodiment of the preferred the voice animation editor 41.

In the preferred embodiment, all recorded utterances are defined to words. In other embodiments, the term utterance may be defined differently.

FIG. 8 illustrates the command menus of the preferred embodiment.

Actuating a "system" command displays a menu (not shown) which provides access to information related to various applications accessible by the host system, the voice animation system, for example. For example, the scratch pad command (not shown) brings up the host operator's scratch pad.

FIG. 8*a* illustrates the "reference" menu 81. The commands in this menu are in four groups. The first group are for manipulating voice reference files. The second group are for manipulating a voice reference file's different voice segmentations. The third group toggle display of the windows they name. The fourth group contains the "quit" command which terminates the use of the editor until it is invoked again.

FIG. 8*b* illustrates the "dictionary" menu 82. The commands in this menu are used to manipulate segmentation dictionary files. The first group manipulate the files themselves. The second group manipulates the contents of the currently open file. The dictionary editor command toggles display of the dictionary editor window.

FIG. 8*c* illustrates the "language" menu 83. The commands in this menu are used to manipulate language files. The first group of commands manipulate the files themselves. The second group allow the user to create and delete new segmentation rule sets for the current language file. The rules editor command toggles display of the rules editor window.

FIG. 8*d* illustrates the "Voice Animator" menu 84. The commands in this menu control the voice animator. The Voice Animator command displays the Voice Animator window. The other commands toggle various configuration states in the voice animator.

FIG. 8*e* illustrates the "window" menu 85. The commands in this menu toggle the display of the windows that they refer to.

FIG. 8*f* illustrates the "shortcuts" menu 86. This menu contains a variety of commands. The "batch mode slice . . . " and "batch mode slice from scratch pad" commands run the automatic segmenter. The delete cut segment command removes an extracted segment that is so faulty that it cannot be corrected. The remaining commands simplify many repetitious tasks for the operator.

Appendix D attached hereto illustrates a fragment of code from the preferred embodiment of the voice animation editor 41. This code implements the "impact of current segment" command in the "shortcuts" menu. This command is used while searching for erroneous segments. Often the operator finds that the synthesis of a particular dictionary segment is causing the problem. One solution to this problem would be to simply delete the segment from the voice segmentation file. This would force the voice animator to choose a different occurrence of instance of the segment for resynthesizing the utterance. The segment in question may, however, sound clear in most of the remaining dictionary words that are synthesized using that segment. The "impact of current segment" command in the "shortcuts" menu is used to determine this. With the segment in question in the current segment window and the segment's word source in the current word window, this function will use the voice animator to synthesize all the words listed in the current segment window. Any of these dictionary words which use the specified instance of the segment will be entered in the Voice Animator window. The result is a list of every dictionary word which is resynthesized by the voice animator using that segment instance. The operator can then listen to the resynthesized words and determine whether the segment in question is in fact erroneous.

FIG. 8*g* illustrates the "debugging" menu 87. These commands are used in the development of the system and are not needed in other embodiments.

FIG. 9 illustrates the normal use of the preferred embodiment of the voice editor 41.

Figure 9A:
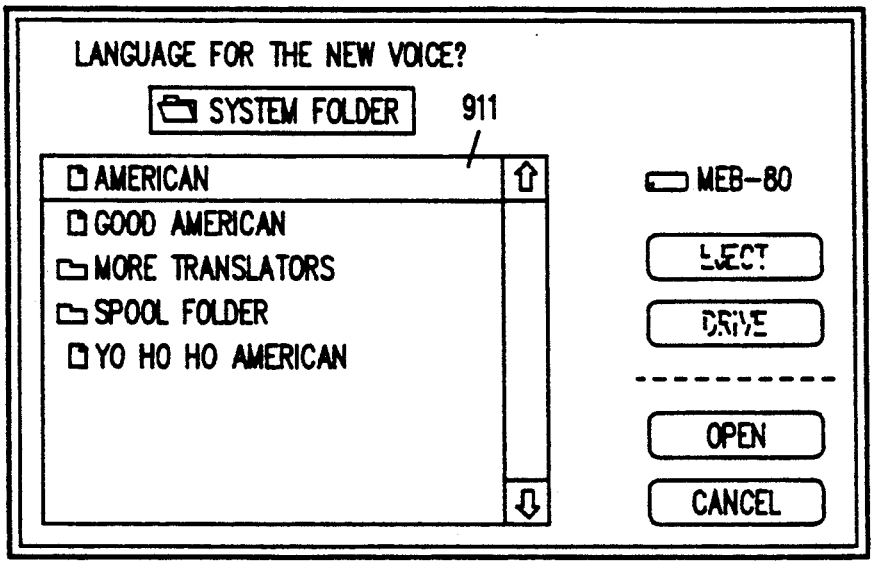
FIGS. 9*a*–9*j* are detailed presentations illustrating the screen layout for various procedural steps utilized for the voice editor shown in FIG. 4.
Figure 9B:
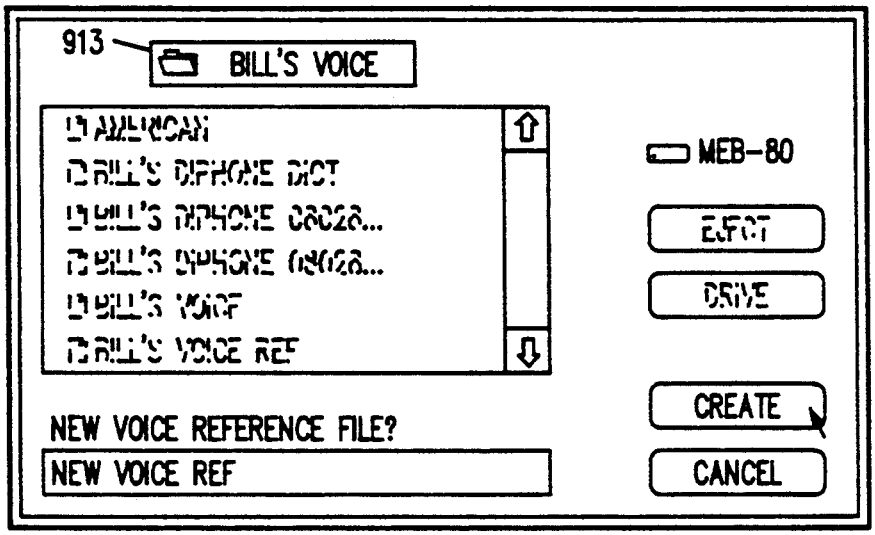

FIGS. 9*a* and 9*b* illustrate the process of creating a new voice reference file. FIG. 9*a* illustrates the operator selecting an existing language file 911 to be associated with the new voice reference file. FIG. 9*b* illustrates the operator creating and naming a new voice reference file 913.

Figure 9C:
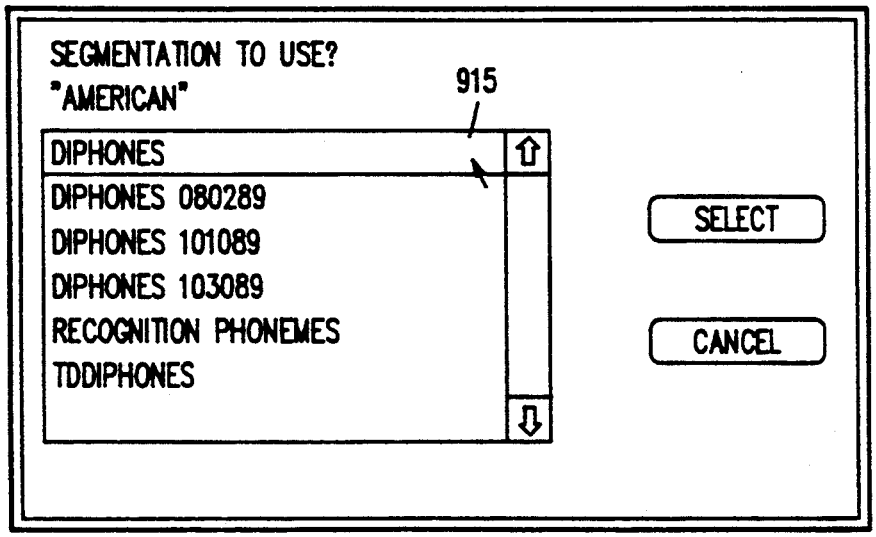
Figure 9D:
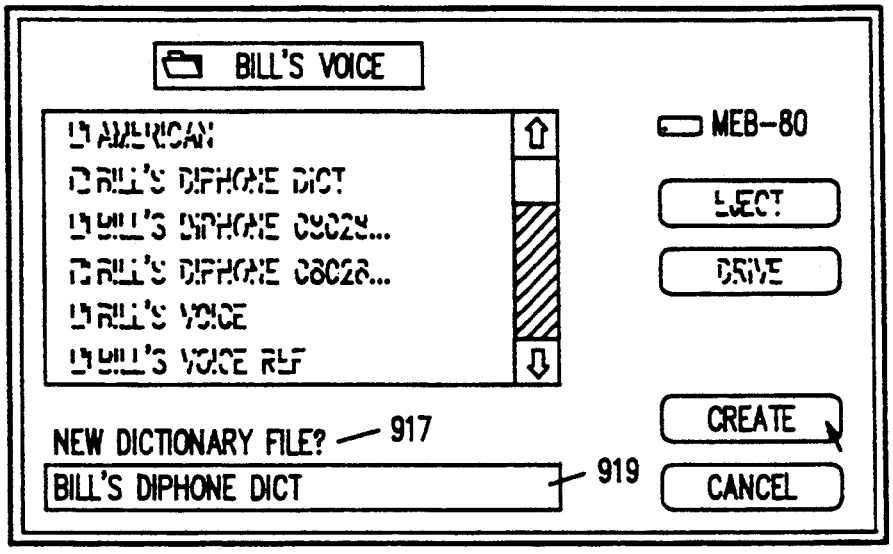
Figure 9E:
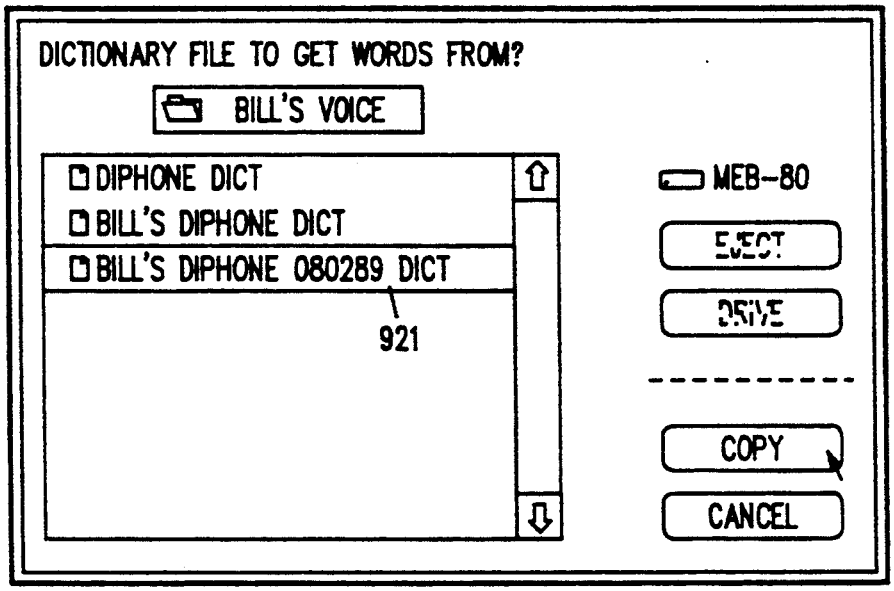
Figure 9F:
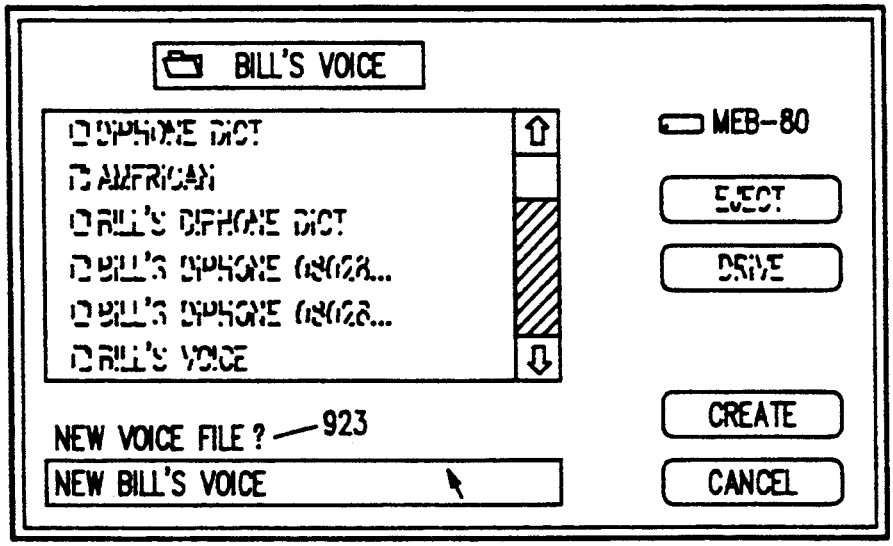

FIGS. 9*c* through 9*f* illustrate the creation of a new voice segmentation. FIG. 9*c* illustrates the operator selecting a segmentation scheme 915 for the voice segmentation from the selected language file 911. FIGS. 9*d* and 9*e* illustrate the operator creating and naming a segmentation dictionary file 917. FIG. 9*d* illustrates the creation and naming of an empty file 919. FIG. 9*e* illustrates the operator choosing an existing dictionary 921 whose word list will be used to generate the new dictionary. Other embodiments might actually keep the word list with the segmentation rules in the language file. FIG. 9*f* shows the operator creating and naming a new segmentation voice file 923.

Figure 9G:
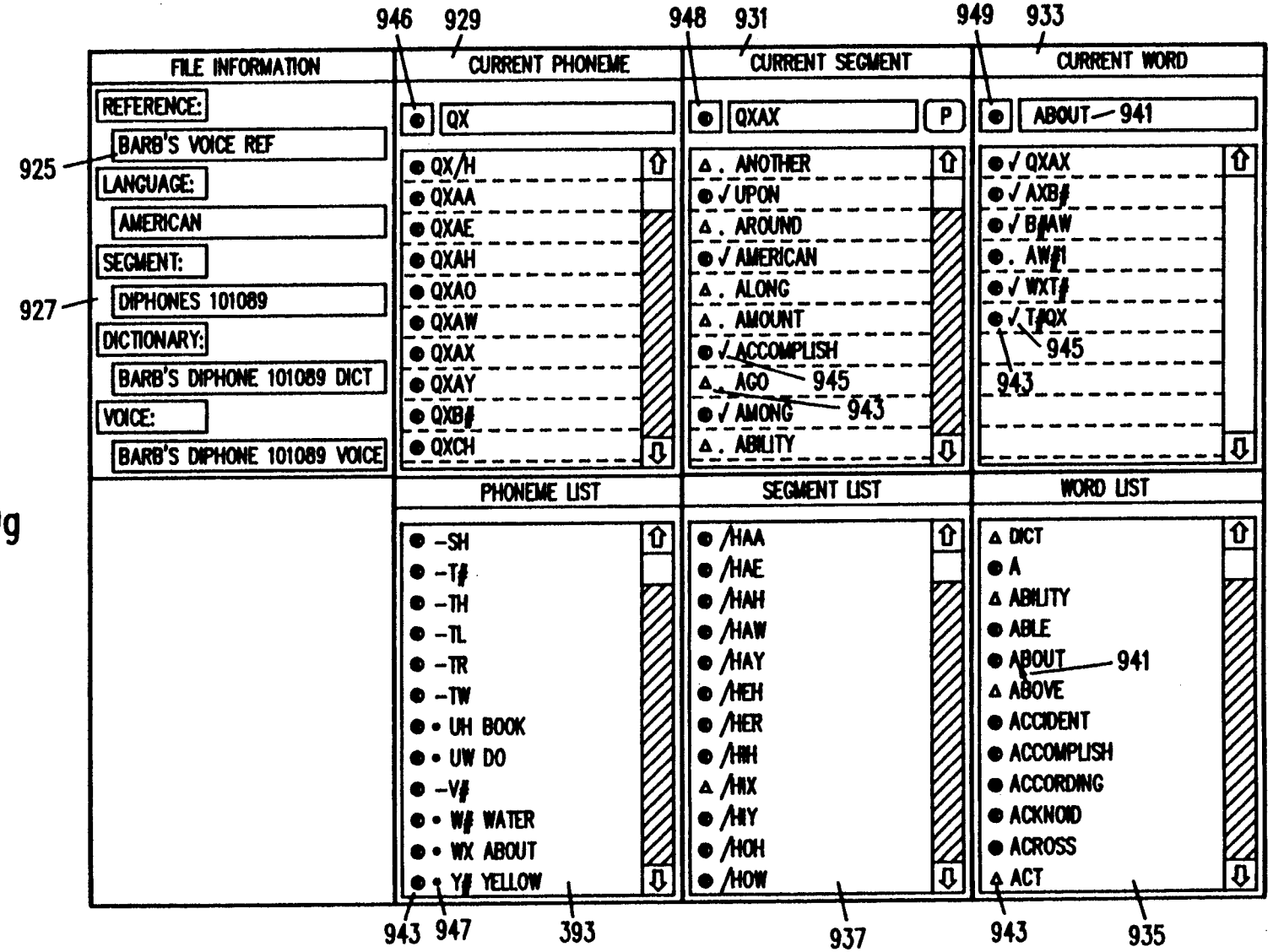
Figure 9H:
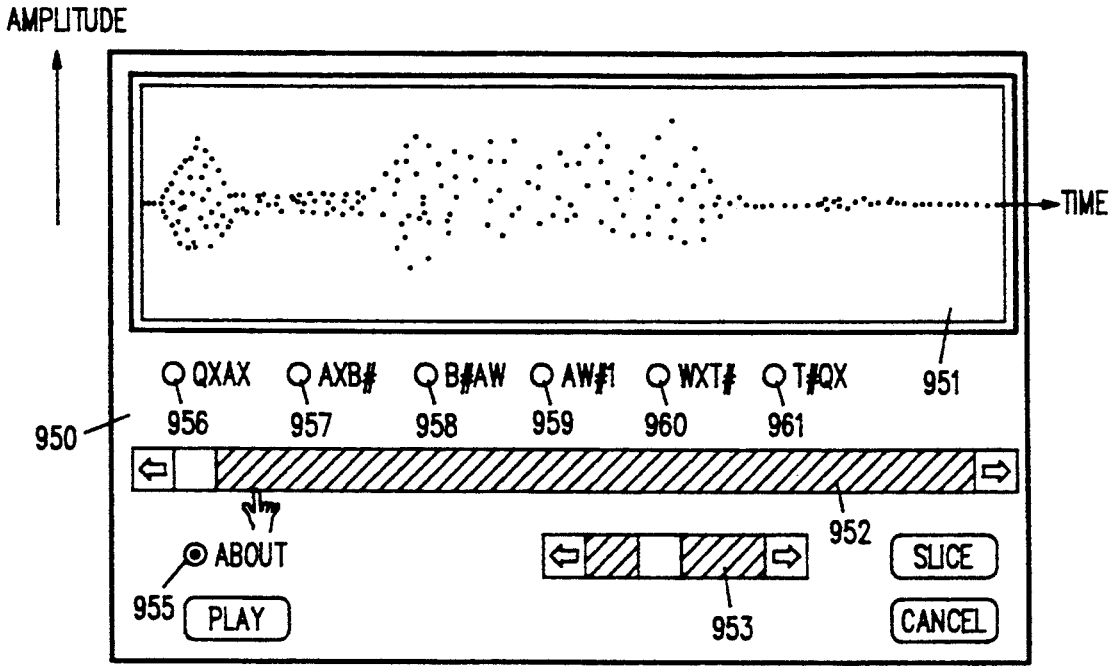

FIG. 9*g* illustrates the voice editor after the voice reference file has been opened (either by creating a new one as in FIGS. 9*a*-9*f* or by opening a previously created voice reference file such as 'Barb's Voice Ref' 925). The file information window 927 shows the name of the various files that have been opened. The current phoneme 929, current segment 931 and current word 933 windows will be empty or blank if the user has not yet selected contents for them from their corresponding list windows.

The word list window 935 alphabetically lists all the words in the segmentation dictionary file and their status (status marks 943). A triangular status mark indicates that the word has not been recorded. A circle-R status mark (not shown) indicates that the word has been recorded but no segments have been extracted from it. A circle-C status mark indicates that segments have been extracted from the word.

The segment list window 937 alphabetically lists all the segments in the segmentation dictionary file and their status. The status marks have the congruent meanings to those in the word list window.

The phoneme list window 939 alphabetically lists all the phonemes that begin segments in the segmentation dictionary file and their status. The first status mark 943 for each phoneme has a meaning congruent to the status mark in the segment list and word list windows. The second mark 947 indicates whether the phoneme has been marked as one requiring blending. This last piece of information is used by the automatic segmenter to determine a segment's prosodic environment. A bullet status mark 947 indicates that the phoneme requires blending.

FIG. 9*g* illustrates the voice editor after the user has selected the dictionary word "about" 941 (as indicated by the mouse arrow); its first segment appears in the current segment window 931 and the first phoneme of its first segment appears in the current phoneme window 929.

The current word window 933 shows the selected word, "about" 941, its status, the segments that comprise it and their status. The word status mark 949 and the first status mark 943 for each segment are identical to the similar marks in the word list 935 and segment list 937 windows. The second status mark 945 for each segment indicates whether or not an instance of this segment has been extracted from the displayed word. A check-mark 945 indicates that an instance of the segment has been extracted from this word.

The current segment window 931 illustrates the currently selected segment, its status, the words that contain it and their status. The segment status mark 948 and the first status mark 943 for each word are identical to those in the segment list 937 and word list 935 windows as described above. The second status mark 945 for each word indicates whether or not the current segment 931 has been extracted from that word. The voice editor allows the user to keep many examples of each segment so as to record how the segment varies in different prosodic environments.

The current phoneme window 929 illustrates the currently selected phoneme, its status mark, all the segments that begin with it and their status marks. The status mark 940 of the current phoneme is identical to its first status mark 943 in the phoneme list window 939. The status mark of each listed segment is identical to its status mark in the segment list window 939.

Referring again to FIGS. *7c* and *7d*, the recording studio 627 and recorder 629 windows are illustrated being used to record the current word. The user configures the analog-to-digital package by using the controls in the recorder window 629. Other embodiments may use other suitable recording apparatus or configurations.

The user then transfers control to the recording apparatus to obtain a recording of the displayed current word 941. When control is returned to the voice editor, the recording level is displayed. If the recording level was too high or low, i.e., too loud or too soft, the user can re-record the word at the desired level. The user can also play back the recording to determine whether or not the recording has acceptable quality beyond the required level tolerances. The level of quality control required is a function of the dynamic range of the digitized data and the requirement to match or blend segments at their boundaries. Other preferred embodiments may utilize different quality control methods as determined by the digitizing and recombination methods utilized in the particular embodiment. The user can then either save the recording or otherwise dispose of it.

Referring again to FIG. *7b*, the use of the dictionary editor 613 is illustrated. A list of the segments 622 in the current word 620 are placed in the dictionary editor field 612. The user has then replaced the segment "B#AW" 628 with "B#AA" 630 in the dictionary editor field 612. Utilizing the "add word" and "remove word" buttons 614, the user can modify the stored list 622 of segments to correct for pronunciation variation among different speakers.

FIGS. *7f* and *9h–9i* illustrate the slicing table window 631 being used to extract segments from a recording.

FIG. *7f* illustrates the slicing table window 631 and its controls. The "auto-slice" button 632 automatically segments the entire recording library. The "slice-blender" button 634 is used to extract a single pitch period of the voiced phoneme and operates similarly to the segment extraction described below.

FIG. *9h* illustrates a sound editor screen display 950 that appears when the user has pressed the "slice-word" button 636 displayed by the slicing table window 631. The display 951 is a waveform representation of the sound generated with a special font and the voice animation system's text editing facilities. The 8-bit sample values in the sound are interpreted as characters and the font displays these values as 128×1 pixel "characters" placing a dot at the appropriate amplitude. The upper horizontal scroll bar 952 provides horizontal adjustment of the portion of the waveform viewed by the window 951. The lower scroll bar 953 adjusts the resolution of the display. The button 955 with the name of the word adjacent to it is used to mark the location of desired or meaningful data in the recording. The buttons 956–961 labeled with the word's segments (from the segment list) are used to mark the locations of the segments. The current segment boundaries are marked along the bottom of the display by triangularly-shaped markers. The right or left boundary of a particular segment is marked by the vertical side of the triangular marker. As shown, there may be some overlap of the segment boundaries. The button marked play plays the selected portion of the sound. The buttons marked "slice" and "cancel" are for the user to indicate that the sound has been edited and that the results should be stored or cancelled, as desired.

The voice editor allows the operator to change the location of a segment or to indicate that the segment should not be extracted from this word by pressing the segment's associated button while holding down a modifier key.

FIG. *9i* illustrates the sixth segment 961 being extracted with the display shown at its highest resolution. The user has located the beginning of the "T#QX" 961 diphone at the instant of the plosive burst (indicated by triangular index 971 at bottom, left-hand corner of display). The segment begins with a blended phoneme and is overlapped with the preceding segment as indicated by the markings at the bottom of the display (as shown in FIG. *9h*). Three pitch periods have been found empirically to be a good overlap for both male and female voices. The display corrects the operator's marking to the nearest negative-going zero crossing to avoid clicks when the unprocessed segments are recombined. The mark must be accurately placed in the vicinity of the glottal pulse in voiced speech to avoid unnatural rapid glottal pulses at segment boundaries when unprocessed segments are recombined. By dividing all plosive diphones at the burst instance 971, the voice animator 43 can accurately place the plosive burst in the output signal. For example, the plosive excitation for an enhanced LPC data representation can be placed precisely at the beginning of the associated segment.

Figure 9I:
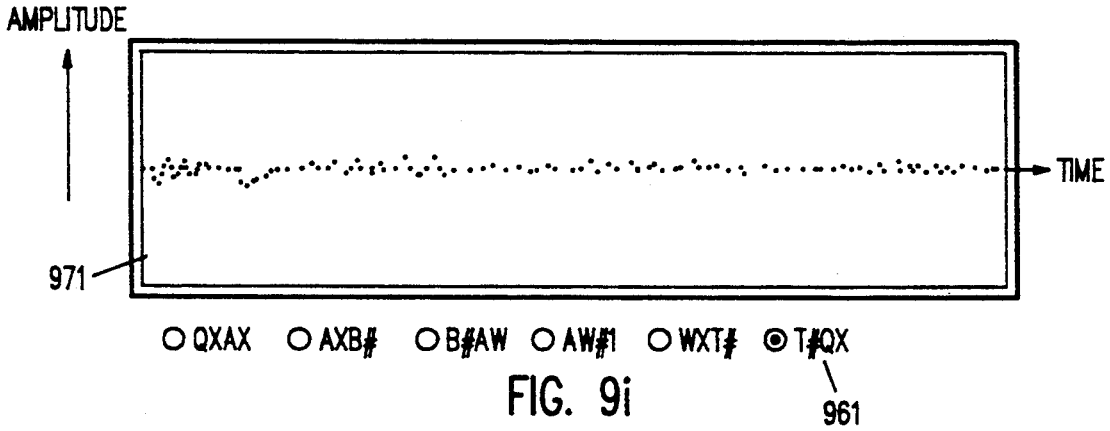
Figure 9J:
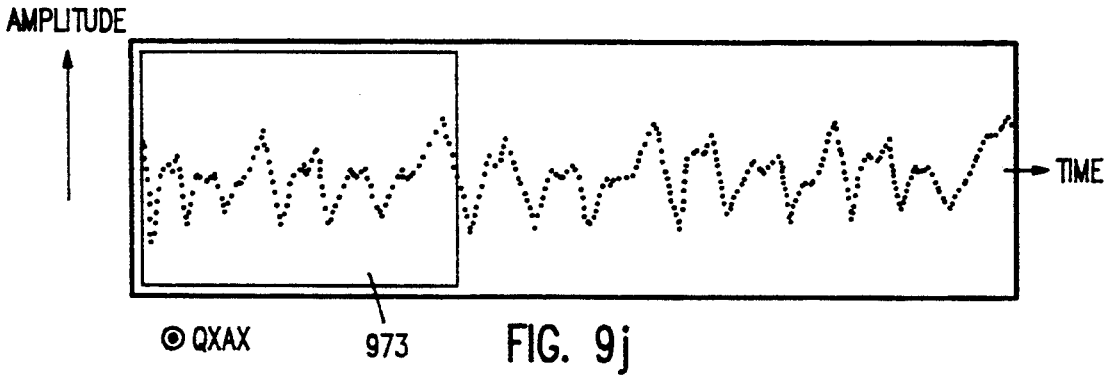

FIG. *9j* illustrates a voice editor 950 marking mode which may be used to smooth or correct the prosodic environment information and to accurately provide a segment's ending pitch value. Rather than marking the location of a segment (as in FIG. *9i*), the section 973 of the segment, "QXAX", for example, that is inside three pitch periods from each end of the sound is marked. For unvoiced speech the length of this section is zero, which indicates that no prosodic variation is needed. Other embodiments of the present invention could select and store prosodic environment information in a different manner, for example by detection of a glottal pulse in an auto-regressive residual excitation signal. This method could also be used to locate glottal pulses while marking the segments such as shown in FIG. 9*i*.

Figure 10:
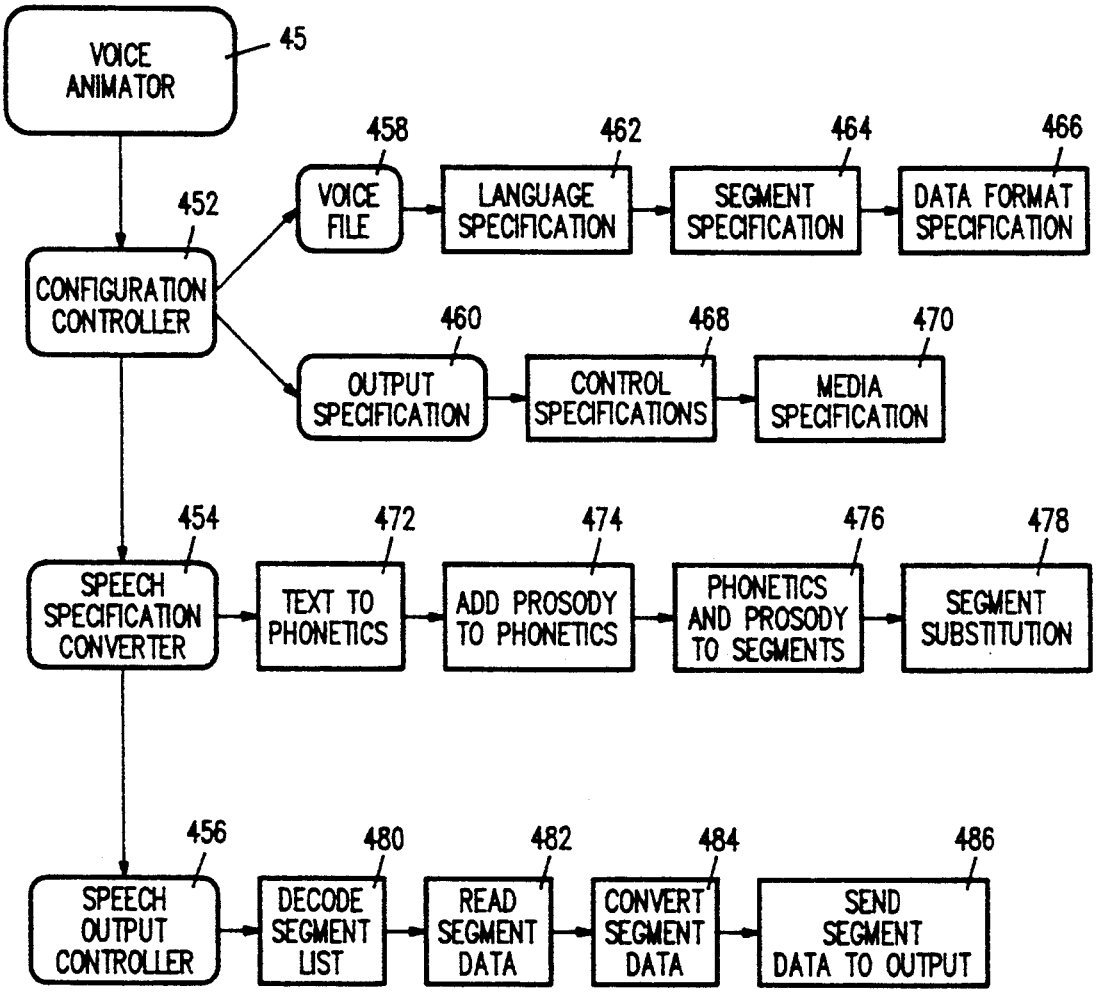
FIG. 10 is a block diagram illustrating a flow chart of the procedures and controls of the voice animation controller section.

Referring now also to FIG. 10, the flow of control in the voice animation controller 43 is shown. The voice animation controller 43 includes three subcontrollers, the configuration controller 452, the speech specification 454 and the speech output controller 456 with the indicated processes or events usually executed in the order shown. The voice animation controller configuration can be altered at any time via the configuration controller 452 and output can be produced sending a segment list to the speech output controller 456 via the speech specification converter 454.

The configuration controller 452 accepts commands from the user to provide the voice file 458 and the output specification 460 to the speech specification converter 454 for configuring the voice animator 45 for the particular voice to be synthesized. The voice file 458 comprises a language specification 462, a specification 466 and a data format specification 466. The data format specification 466 is a controller which translates the stored voice data into recordings in a single format (called the standard format) and provides synchronization with any external controller specified in the output control specification 468 (described below). The output specification 460 consists of a media specification 470 and other output control specifications 468. The media specification 470 is a controller that will access the list of audio segments produced by the voice editor 41 and produce the output desired, typically driving the audio generator of the host microcomputer, but possibly writing the output to another storage medium or otherwise further processing the output as desired. The control specifications 468 include references to an external controller that may be used to synchronize other controllers with the voice animation controller 43 and any additional control specifications that may be implemented in a particular preferred embodiment for modification of the basic audio output. Other preferred embodiments might implement other similar types of controls to vary the quality of the produced synthetic voice.

The configuration controller 452 also accepts commands found in the configuration scripts: for example, a given voice file's configuration script will indicate the language and segmentation rules that should be used in converting text to segment lists for voice animation.

The speech specification converter 454 utilizing the voice and output specification files 458, 460 converts text (user input via keyboard 15 or other input device) to phonetics 472. A segment list corresponding to the desired text is then created by applying the segmentation rules 476 and segment substitution rules 478 and coupled to the speech output controller 456. The speech output controller 456 converts the segment list provided by the speech specification converter 454 to an audio waveform which constitutes an output signal to the speech synthesizer or other output device. The segment list is first decoded 480 into a sequence of segment names with associated prosodic environments. Each segment is then read 482 in, converted to the standard format 484 and sent 486 to the medium output controller specified by the user in the media specification 470.

Appendix E attached hereto defines the commands necessary to implement the voice animation controller 43 and which executes the process flows as shown in FIG. 10. The procedure defined performs the passing of the input text to provide the output synthesized speech corresponding to the input text. The instruction flags used by the system are defined as follows.

The "stress" flag used by the preferred embodiment is set to indicate that stressed syllables should be generated. When cleared, only unstressed syllables are generated.

The "prosody" flag used by the preferred embodiment is set to indicate that prosody should be generated. If this flag is cleared, the preferred embodiment will generate speech with no pitch or volume variation.

The "blending" flag used by the preferred embodiment is set to indicate that adjacent segments should be blended together. How this blending is accomplished depends on the data expansion scheme. For the representation used in voice segmentation files, the segments are overlapped and crossfaded. For the filter model representation, FIG. 5*g*, nothing is done.

The "substitution" flag used by the preferred embodiment is set to indicate that segment substitution should be used. If it is cleared, the output stage will generate a error message for each missing segment.

The "editing" flag used by the preferred embodiment is set to indicate that the voice editor is modifying the voice file and hence various speed optomizations should not be used.

The "pitch numeric value used by the preferred embodiment is the prosody pitch that should be used for all segments that have no prosody pitch specified.

The "synchronization" numeric value used by the preferred embodiment is the address of a procedure to call whenever a segment has been sent to the output.

The "set expansion [expansion name]" indicates that the preferred embodiment should use the named data expansion controller.

The "set output [output name]" indicates that the preferred embodiment should use the named output medium controller.

In the preferred embodiment speech samples may be stored in a natural data representation; i.e., non-encoded digitized speech. Since the speech segment data is not encoded, it is not necessary to encode and store any of the residual excitation noise. An example of a segmentation voice file structure for natural data representation is shown in FIG. 5*c*. In this type of data representation prosodic pitch variation is generated by pitch bending effects. A segment is stored with a record of its starting and ending pitches. During resynthesis of the segment, different pitches will be specified by the segment specification and the natural data representation's data expansion controller must alter the stored data to have the specified pitches. This is accomplished by linear pitch bending which requires quadratically indexed copying and interpolation/decimation of the resulting signal. Appendix F attached hereto illustrates both C and MC68000 assembly language examples of code to accomplish the pitch bending using the quadratic transfer function $$y(t)=(A*t*t+B*t)/D,$$

where t is the index in the original sample and y(t) is the index in the processed sample. The coefficients A, B and D are calculated so that dy/dt(0)=desired starting pitch/original starting pitch and dy/dt (last original sample)=desired ending pitch/original ending pitch.

Although the present invention has been shown and described in connection with certain specific embodiments, it will be readily apparent to those skilled in the art that various changes in form and arrangement of the components may be made without departing from the spirit of the invention or exceeding the scope of the claims appended hereto.

5

Appendix A

```
static void parcor_synthesis_filter1_fast (

/* - - - - - - - P A R A M E T E R S - - - - - - - - */

    register    z_signed_sample_ptr     e_plus,
    register    int                     *e_minus_n,
                int                     *parcor_parameters,
                int                     gain,
                z_sample_offset         window_length,
                int                     parameter_count)

/* - - - - - - - - - - B E G I N - - - - - - - - - - */

    { /* begin parcor_synthesis_filter1_fast */

/* - - - - - - - L O C A L   D E F S - - - - - - - */

#define IN_SCALING      (GAIN_SCALING-SYNTHESIS_SCALING+RESIDUAL_SCALING)

/* - - - - - - L O C A L   S T A T I C S - - - - - - */

/* - - - - L O C A L   V A R I A B L E S - - - - - */

        register    int   i;
        register    int   n;

        register    int   e_plus_temp;    /* 68000 only multiplies int's */
        register    int   e_minus_temp;
        register    int   loop_signal;

/* - - - - - - - - - - - B O D Y - - - - - - - - - - - - - - */

asm {
    movea.l  parcor_parameters,a1  ; a1 = parcor_parameters
    movea.l  e_minus_n,a0          ; a0 = e_minus_n + 1
    move.w  (a0)+,d2

    move.w  gain,d2                ; d2 = gain
    move.w  parameter_count,d1     ; d1 = parameter_count * 2
    asl.w  #1,d1

    move.l  window_length,n        ; n = window_length
    bra  @ntest

@nloop:
        add.w  d1,e_minus_n                ; Reset pointers: e_minus_n
        add.w  d1,a0                       ; e_minus_n+1
        add.w  d1,a1                       ; parcor_parameters
```

```
        move.b  (e_plus),e_plus_temp      ; e_plus_temp = *e_plus * gain
        ext.w  e_plus_temp
        muls  d2,e_plus_temp
        asr.l  #IN_SCALING,e_plus_temp    ; rescale  e_plus_temp
        negx.w  e_plus_temp               ; round it off (negative signal)

        move.w  d1,i                      ; i = parameter_count

    asr.w  #1,i                                ;    = d1/2
    bra  @itest
@iloop:
        move.w  -(e_minus_n),e_minus_temp         ; e_minus_temp  =  *e_minus_n

        move.w  e_minus_temp,loop_signal
        sub.w  e_plus_temp,loop_signal

        muls  -(a1),loop_signal                   ; k[i] (muls <= 54 cycles)
        asr.l  #Z_PARCOR_SCALING,loop_signal      ; rescale  loop_signal
        negx.w  loop_signal                       ; round it off

        sub.w  loop_signal,e_plus_temp            ; subtraction because of
        sub.w  loop_signal,e_minus_temp           ; roundoff negation

        move.w  e_minus_temp,-(a0)                ;  e_minus[i][n]
     @itest:
         dbra  i,@iloop                           ; --i != -1

     move.w  e_plus_temp,(e_minus_n)          ;  e_minus[0][n]

     asr.w  #SYNTHESIS_SCALING,e_plus_temp
     negx.w  e_plus_temp                      ; round it off (positive signal)

     move.b  e_plus_temp,(e_plus)+            ; e_plus [0][n]

  @ntest:
     dbra  n,@nloop                           ; --n != -1
  } /* asm */


  /*  -  -  -  -  -  -  -  -  C  L  E  A  N  -  U  P  -  -  -  -  -  -  -  -  -  */

  #undef  IN_SCALING

  /*  -  -  -  -  -  -  -  -  -  R  E  T  U  R  N  -  -  -  -  -  -  -  -  -  -  */

         return;

  /*  -  -  -  -  -  -  -  -  -  -  E  N  D  -  -  -  -  -  -  -  -  -  -  -  -  */

     } /* end parcor_synthesis_filter1_fast */
```

Appendix B

```
z_sound_handle z_copy_subsound (sound, start, stop)

/* - - - - - - - P A R A M E T E R S - - - - - - - - - */

    z_sound_handle sound;
    z_sample_offset start;
    z_sample_offset stop;

/* - - - - - - - - - B E G I N - - - - - - - - - - - - */

    { /* begin z_copy_subsound */

/* - - - - - - - L O C A L   D E F S - - - - - - - */

/* - - - - - - L O C A L   S T A T I C S - - - - - - */

/* - - - - - L O C A L   V A R I A B L E S - - - - - */

    z_sound_info_record sound_info;
    SoundHeader         *sound_header;

    z_sample_offset     dl;



/* - - - - - - - - - - - B O D Y - - - - - - - - - - - - - */

        if (HandToHand (&sound)) return (0L);

        HLock (sound);

        z_get_sound_info (sound, &sound_info);
        sound_header = (SoundHeader *) sound_info.data;

        if (start == Z_NULL_SAMPLE_OFFSET) start = 0;
        if (stop  == Z_NULL_SAMPLE_OFFSET) stop  = sound_header->length;

        if (start < 0) start = 0;
        if (stop  < 0) stop  = 0;
        if (start > sound_header->length) start = sound_header->length;
        if (stop  > sound_header->length) stop  = sound_header->length;

        if (stop < start) stop = start;

        dl = sound_header->length - (stop - start);
        sound_header->length    = stop - start;
        sound_header->loopEnd   = sound_header->length  - 1;
        sound_header->loopStart = sound_header->loopEnd - 1;

        BlockMove (sound_header->sampleArea + start,
                   sound_header->sampleArea,
                   sound_header->length);
```

```
        HUnlock (sound);

        SetHandleSize (sound, GetHandleSize (sound) - dl);
/* - - - - - - - - C L E A N - U P - - - - - - - - - - - - */
/* - - - - - - - - - R E T U R N - - - - - - - - - - - - - */
        return (sound);
```

Untitled
Tuesday, November 7, 1989 1:38 PM

```
/* - - - - - - - - - - E N D - - - - - - - - - - - - - - - */
    } /* end z_copy_subsound */
```

Appendix C m_do_command

- - - - - - - - - - - - - - - - - - - - - - - - - - - - - -

Purpose: This procedure does the parsing of our input string. It is actually a switching station to call either commands (if only one keyword is required) or other sub-switching stations to continue the parsing. In the interest of clarity, all commands are defined here.

- - - - - - - - - - - - - - - - - - - - - - - - - - - - - -

NEW REFERENCE [filename]
Creates a new MUTANT voice reference file by prompting the user for a language, segmentation, dictionary, and voice file. All are opened.
Returns {"TRUE" / "FALSE"}

NEW DICTIONARY [filename]
Creates a new MUTANT dictionary file, and prompts the user for a language, segmentation, and source dictionary to get words from
Returns {Dictonary Name}

NEW SEGMENTATION [filename]
Creates and adds a new segmentation scheme to an existing MUTANT reference file. New dictionary and voice files are created.
Returns {"TRUE" / "FALSE"}

NEW LANGUAGE [filename]
Creates a new language file with an empty rule set.
Returns {"TRUE" / "FALSE"}

.....

OPEN REFERENCE
Opens a MUTANT reference file.
Returns {"TRUE" / "FALSE"}

OPEN DICTIONARY
Opens a MUTANT dictionary file.
Returns {"TRUE" / "FALSE"}

OPEN LANGUAGE
Opens a MUTANT language file.
Returns {"TRUE" / "FALSE"}

CLOSE REFERENCE
Closes a MUTANT reference file.
Returns {"TRUE" / "FALSE"}

CLOSE DICTIONARY
Closes a MUTANT dictionary file.
Returns {"TRUE" / "FALSE"}

CLOSE LANGUAGE
Closes a MUTANT language file.
Returns {"TRUE" / "FALSE"}

.....

DELETE REFERENCE
Deletes a MUTANT reference file.
Returns {"TRUE" / "FALSE"}

DELETE DICTIONARY
Deletes a MUTANT dictionary file.
Returns {"TRUE" / "FALSE"}

DELETE LANGUAGE
Deletes a MUTANT language file.
Returns {"TRUE" / "FALSE"}

.....

LIST DICTIONARY WORDS
Looks up all words in a MUTANT dictionary file,
and returns them, each preceeded by its status.
Returns {List of words with status}

LIST DICTIONARY SEGMENTS
Looks up all segments in a MUTANT dictionary file, and returns them, each preceeded by its status.
Returns {List of segments with status}

LIST DICTIONARY PHONEMES
Looks up all phonemes in a MUTANT dictionary file, and returns them, each preceeded by its status.
Returns {List of phonemes with status}

LIST LANGUAGE SEGMENTS
Looks up all segmentations in a language file.
Returns {List of segmentations}

LIST OBJECTS {type}

GET DICTIONARY NAME
Looks up a dictionary's name.
Returns {Name of dictionary}

GET DICTIONARY WORD {word}
Looks up a words segment list in the dictionary.
Returns {List of segments}

GET DICTIONARY SEGMENTS {segment}
Looks up a segments word list in the dictionary.
Returns {List of words}

GET DICTIONARY PHONEME {phoneme}
Looks up a phonemes segment list in the dictionary.
Returns {List of segments}

GET DICTIONARY ID {number}
Looks up a word (given its ID number) in the dictionary.
Returns {Word}

GET WORD STATUS {word}
Gets the cut/recorded/virgin status of a word.
Returns {status symbol}

GET WORD SOURCES {word}
Looks up a words segment list, AND the status of each segment.
Returns {List of segments w/status}

GET SEGMENTation NAME
Gets the name of the current segmentation scheme.
Returns {segmentation name}

GET SEGMENTation RULES {name}
Gets the current segmentation scheme's rules.
Returns {segmentation rules}

GET SEGMENT STATUS {segment}
Gets the cut/recorded/untouched status of a segment.
Returns {status symbol}

GET SEGMENT SOURCES {segment}

GET REFERENCE NAME
Gets the name of the current MUTANT reference file.
Returns {reference filename}

GET LANGUAGE NAME
Gets the name of the current MUTANT language file.
Returns {language name}

GET LANGUAGE RULES
Gets the current langugage rules.
Returns {language rules }

GET VOICE NAME
Gets the name of the current MUTANT voice file.
Returns {voice file name}

GET VOICE SEGMENT {segment}
Gets a list of words from which the given segment WAS cut.
Returns {list of words}

GET SUBSTITUTION NAME
Gets the name of the current MUTANT substitution rsrc.
Returns {substitution name}

GET SUBSTITUTION RULES
Gets a the substitution rules from the current voice file.
Returns {substitution rules}

GET PROSODY NAME
Gets the name of the current MUTANT prosody rsrc.
Returns {prosody name}

GET PROSODY RULES
Gets a the prosody rules from the current language file.
Returns {prosody rules}

ADD RECORDING {word}
Adds the recorded word to the MUTANT reference file.
Returns {"TRUE" / "FALSE"}

ADD DICTIONARY {word} {segment list}
Adds the word and its segment list to the MUTANT dictionary file.
Returns {"TRUE" / "FALSE"}

ADD SEGMENTATION RULES {name}
Adds the segmentation rules to the language file.
Returns {"TRUE" / "FALSE"}

ADD SUBSTITUTION RULES {name}
Adds the substitution rules to the voice file.
Returns {"TRUE" / "FALSE"}

ADD OBJECT {code} {name} {data}
Adds the object composed of DATA and distinguished by type CODE and NAME to a file.
Returns {"TRUE" / "FALSE"}

.....

CHANGE LANGUAGE RULES {name} {data}
Deletes the existing rules and saves the new data.
Returns {"TRUE" / "FALSE"}

CHANGE PROSODY RULES {name} {data}
Deletes the existing rules and saves the new data.
Returns {"TRUE" / "FALSE"}

CHANGE SEGMENTATION RULES {name} {data}
Deletes the existing rules and saves the new data.
Returns {"TRUE" / "FALSE"}

CHANGE SUBSTITUTION RULES {name} {data}
Deletes the existing rules and saves the new data.
Returns {"TRUE" / "FALSE"}

CHANGE OBJECT RULES {code} {name} {data}
Deletes a rsrc of type CODE and NAME and puts DATA in its place.

REMOVE DICTIONARY {word}
Removes WORD from the current dictionary file.
Returns {"TRUE" / "FALSE"}

REMOVE SEGMENTATION {name}
Removes a segmentation rsrc from the reference file.
Returns {"TRUE" / "FALSE"}

REMOVE SUSBSTITUTION {name}
Removes a substitution rsrc from the voice file.
Returns {"TRUE" / "FALSE"}

REMOVE OBJECT {code} {name}
Removes rsrc object of type CODE and NAME from a file.
Returns {"TRUE" / "FALSE"}

.....

SLICE VOICE
Auto slices the current voice.
Returns {"TRUE" / "FALSE"}

SLICE WORD {word}
Brings up the slicing dialog box for the given word.
Segment boundaries will be guessed if possible.
Returns {List of sliced segments}

SLICE BLENDER {phoneme} {word}
Slices a blender from the indicated word.
Returns {"TRUE" / "FALSE"}

.....

MARK {segment} {word}
Brings up a splicing dialog box to mark the segment
from the indicated word.
Returns {"TRUE" / "FALSE"}

.....

SET REPRESENTATION {representation name}
Lets the user choose a representation
(i.e. compression) format.
Returns {"TRUE" / "FALSE"}

BUILD REPRESENTATION [filename]
Builds a representation (i.e. compression) of the
voice file data in another file.
Returns {"TRUE" / "FALSE"}

.....

LEVEL {sound}
Gets the level of a sound.
Returns {level}

.....

SEED

Seeds the automatic segmenter.
Returns {"TRUE" / "FALSE"}

.....

PLAY {sound}

Plays the indicated sound.
Returns {"TRUE" / "FALSE"}

Appendix D

```
on itemSelect
  global have_initialized_BrightTalk
  global current_word

  put field "Segment Word List" of wd "Current Segment" into the_list
  if the_list is empty then exit itemSelect

  if not have_initialized_BrightTalk then
    send "initialize_BrightTalk" to item "BrightTalk™" of menu "BrightTalk™"
  end if

  put empty into new_list
  put the number of lines in the_list into num_lines
  repeat with i = 1 to num_lines
    if the optionKey is down then exit repeat
    put last word of line i of the_list into the_word
    BrightTalk "SPEAK TEXT" && the_word
    if parse_result(the Result) then
      put space & the_word after new_list
    end if
  end repeat

  if new_list is not empty then
    delete char 1 of new_list -- remove extra leading space
  end if
  put new_list into card field "Text" of wd "BrightTalk™"
  put empty into card field "Sources" of wd "BrightTalk™"
  open window "BrightTalk™"
  show_wd "BrightTalk™"
end itemSelect

function parse_result the_source
  global current_segment
  global current_word

  if the_source is empty then return false

  put the number of lines in the_source into num_lines
  repeat with i = 1 to num_lines
    get line i of the_source
    if the number of words in it > 1 then
      delete char 1 of word 1 of it
      if word 1 of it is current_segment then
        Mutant "GET DICT ID" && word 2 of it
        return (the Result is current_word)
```

```
    end if
  end if
end repeat

return false
end parse_result
```

Appendix E b_do_command

- - - - - - - - - - - - - - - - - - - - - - - - - -

Purpose: Parses BrightTalk™ commands. BrightTalk™ accepts the following commands:

<result type> <string type> <string>
Converts a string to the appropriate result type. Returns the converted string or FALSE (if the conversion goes the "wrong way").

Set <flag name> <flag setting>
Sets the internal flag to <flag setting>.
Returns TRUE/FALSE Set <number name> <number>
Sets the internal numeric parameter's value to <number>.
Returns TRUE/FALSE Set <rules type> <rules name>
Uses the rules <rules name> for <rules type> conversion. Nothing is changed if no such <rules name> exists for <rules type>.
Returns TRUE/FALSE Set Voice <voice name>
Attempts to open the voice file <voice name>. If it can't find one, it prompts the user with a dialog box.
Returns TRUE/FALSE Set Expansion [<expansion name>]
Attempts to find the data expansion code resource <expansion name>. If <expansion name> is not specified, the user is prompted for a name.
Returns TRUE/FALSE Set Output [<output name>]
Attempts to find the output code resource <output name>. If <output name> is not specified, the user is prompted for a name.
Returns TRUE/FALSE Get <flag name>
Looks up the value of the internal flag.
Returns <flag setting>/FALSE Appendix F

```
@case0:
    move.l  y,d_y
    sub.l  old_y,d_y
    bne  @case1
        clr.l  d0
        move.b  (y),d0          ; y == old_y
        add.w  d0,d1
        asr.w  #1,d1
        move.b  d1,(y)
        bra  @ttest

@case1:
    subq.l  #1,d_y              ; y == old_y + 1
    bne  @case2
        move.b  d1,(y)
        bra  @ttest

@case2:
    subq.l  #1,d_y              ; y == old_y + 2
    bne  @caseM
        move.b  d1,(y)

        clr.l  d0
        move.b  (old_y)+,d0
        add.w  d0,d1
        asr.w  #1,d1
        move.b  d1,(old_y)
        bra  @ttest             ; y > old_y + 2
                                ; restore d_y
@caseM:
        addq.l  #2,d_y

        move.w  d1,d_value
        clr.l  d0
        move.b  (old_y)+,d0
        sub.w  d0,d_value

        bra  @ytest
    @yloop:
            move.l  y,d0
            sub.l  old_y,d0
            muls  d_value,d0
            divs  d_y,d0
            neg.w  d0
            add.w  d1,d0
            move.b  d0,(old_y)+
        @ytest:
            cmpa.l  old_y,y
            bgt  @yloop
```

Appendix F

```
void b_copy_sample (traveller, traveller_length, bed, A, B, D, level_shift)

/* - - - - - - - P A R A M E T E R S - - - - - - - - */

                z_sample_ptr        traveller;
                z_sample_offset     traveller_length;
                z_sample_ptr        bed;
    register    z_sample_offset     A;
    register    z_sample_offset     B;
    register    z_sample_offset     D;
                int                 level_shift;

/* - - - - - - - - - - B E G I N - - - - - - - - - - - */

    { /* begin b_copy_sample */

/* - - - - - - - L O C A L   D E F S - - - - - - - */

*define ASSEMBLY


/* - - - - - - L O C A L   S T A T I C S - - - - - - */

/* - - - - - L O C A L   V A R I A B L E S - - - - - */

        /* Five data registers */

        /* Three as parameters */

        register    z_sample_offset     DF_i;
        register    z_sample_offset     d_y;

        /* Two address registers */

        register    z_sample_ptr        old_y;
        register    z_sample_ptr        y;

        auto        z_sample_record     traveller_value;

        auto        z_sample_offset     two_A_i;

        auto        z_sample_ptr        traveller_end;

        auto        int                 d_value;

/* - - - - - - - - - - - B O D Y - - - - - - - - - - - - - */

*ifdef ASSEMBLY
        /* Change the values of A and B for efficiency */
```

```
asm {
    add.l  A,B
    asl.l  #1,A                    ; B is only used in A+B
                                   ; A is only used in 2A

    move.l  A,d2
    neg.l  d2                      ; Initialize D*F(i) and 2*A*i at i = -1
                                   ; d2 = two_A_i

    move.l  D,DF_i
    sub.l  d2,DF_i
    sub.l  B,DF_i


    movea.l  bed,y                 ; a1 = traveller
    subq.l  #1,y                   ; a0 = traveller_end
    movea.l  y,old_y

    movea.l  traveller,a1
    movea.l  a1,a0
    add.l  traveller_length,a0
    bra  @ttest
@tloop:
        add.l  d2,DF_i
        add.l  B,DF_i                  ; DF_i %= D, y += DF_i / D

        add.l  A,d2

    @Dloop:
        cmp.l  D,DF_i
        blt  @Dexit
            sub.l  D,DF_i
            addq  #1,y             ; d1 = traveller_value
            bra  @Dloop
    @Dexit:
        clr.l  d1
        move.b  (a1)+,d1
        ; sub.w  #Z_QUIET_SAMPLE,d1
        ; move.w  level_shift,d0
        ; asl.w  d0,d1
        ; add.w  #Z_QUIET_SAMPLE,d1

  @case0:
      move.l  y,d_y
      sub.l  old_y,d_y
      bne  @case1
          clr.l  d0
          move.b  (y),d0       ; y == old_y
          add.w  d0,d1
          asr.w  #1,d1
          move.b  d1,(y)
          bra  @ttest


@case1:
    subq.l  #1,d_y                 ; y == old_y + 1
    bne  @case2
        move.b  d1,(y)
        bra  @ttest
```

```
@case2:
    subq.l  #1,d_y              ; y == old_y + 2
    bne @caseM
        move.b  d1,(y)

        clr.l  d0
        move.b  (old_y)+,d0
        add.w  d0,d1
        asr.w  #1,d1
        move.b  d1,(old_y)
        bra @ttest              ; y > old_y + 2
                                ; restore d_y
@caseM:
        addq.l  #2,d_y

        move.w  d1,d_value
        clr.l  d0
        move.b  (old_y)+,d0
        sub.w  d0,d_value

        bra @ytest
    @yloop:
            move.l  y,d0
            sub.l  old_y,d0
            muls  d_value,d0
            divs  d_y,d0
            neg.w  d0
            add.w  d1,d0
            move.b  d0,(old_y)+
        @ytest:
            cmpa.l  old_y,y
            bgt @yloop

    @ttest:
        movea.l  y,old_y
        cmpa.l  a1,a0
        bgt @tloop
        } /* asm */

#else


 /* Change the values of A and B for efficiency */

 B += A;
 A *= 2;

 /* Initialize D*F(1) and 2*A*1 at 1 = -1 */

 two_A_1 = -A;
 DF_1 = D - (two_A_1 + B);

 y = old_y = bed - 1;

 for (traveller_end = traveller + traveller_length;
      traveller < traveller_end;
      old_y = y) {
```

```
   /* B is only used as "A+B" */
   /* A is only used as 2A */


DF_i += two_A_i + B;
two_A_i += A;

while (DF_i >= D) {
    DF_i -= D;
    y++;
    } /* while */    /* DF_i %= D; y += DF_i / D; */

traveller_value = (((int) ((*traveller++) -   Z_QUIET_SAMPLE)) << level_shift)
                    + Z_QUIET_SAMPLE;

if (!(d_y = y - old_y)) {                    /* y == old_y */
    *y = (((int) *y) + ((int) traveller_value)) >> 1;   /* Division by 2 */
    } /* if */


else if (!--d_y) {                           /* y == old_y + 1 */
    *y = traveller_value;
    } /* else if */

else if (!--d_y) {                           /* y == old_y + 2 */
    *y = traveller_value;                    /* Optimize usual loop: */
    *(old_y + 1) = (((int) *y) + ((int) *old_y)) >> 1;
    } /* else if */

else {                                       /* y > old_y + 2 */
    *y = traveller_value;                    /* Interpolate 2 or more points */
    d_value = ((int) *y) - ((int) *old_y);
    d_y += 2;                                /* Restore d_y */
    while (++old_y < y) {
        *old_y = *y - (((y - old_y) * d_value) / d_y);
        } /* while */
    } /* else */
} /* for */




 #endif

 /* - - - - - - - - C L E A N - U P - - - - - - - - - - */

 /* - - - - - - - - - - R E T U R N - - - - - - - - - - - */

        return;

 /* - - - - - - - - - - - E N D - - - - - - - - - - - - - */

    } /* end b_copy_sample */
```

We claim:

1. Apparatus for speech animation of desired text, comprising:

first input means for receiving speech samples derived from input audio data and for providing a sample speech signal representing said speech samples, said input speech samples being in the voice of a selected person;

first segmentation means coupled to said input means for extracting constituent speech segments in accordance with a predetermined speech segmentation plan from said sample speech signal;

encoding means for digitally encoding said constituent speech segments;

second input means for receiving and encoding desired speech text;

second segmentation means, coupled to said second input means and responsive to desired speech text for segmenting said desired speech text into a plurality of constituent text segments in accordance with said predetermined segmentation plan;

combining means for combining a plurality of said encoded constituent speech segments for providing a digital speech signal representative of desired animated speech corresponding to said desired speech text, said digital speech signal being representative of desired animated speech in the voice of said selected person, each of said plurality of encoded constituent speech segments corresponding to at least one of said plurality of constituent text segments; and storage means for storing said digitally encoded constituent speech segments in at least one predefined voice reference file, said predefined voice reference file comprises a language library for storing predefined sets of language rules associated with a selected language, a recording library for storing recorded speech sequences in said selected language for said selected person, a voice library for storing said encoded constituent speech segments in said selected language for said selected person, whereby a separate predefined voice reference file is defined and identified for each said selected person;

one of said language libraries being defined for each of a plurality of selectable languages, each said language library being accessed by each said voice reference file associated with a selected language, each said language file including:

a set of language segmentation rules defined for said selected language;

a set of prosody rules defined in accordance with said language segmentation rules for said selected language;

a set of text segmentation rules defined in accordance with said language segmentation rules for said selected language; and a set of resynthesis configuration parameters for configuring said combining means for said selected language.

2. Apparatus for speech animation of desired text, comprising:

first input means for receiving speech samples derived from input audio data and for providing a sample speech signal representing said speech samples, said input speech samples being in the voice of a selected person;

first segmentation means coupled to said input means for extracting constituent speech segments in accordance with a predetermined speech segmentation plan from said sample speech signal;

encoding means for digitally encoding said constituent speech segments;

second input means for receiving and encoding desired speech text;

second segmentation means, coupled to said second input means and responsive to desired speech text for segmenting said desired speech text into a plurality of constituent text segments in accordance with said predetermined segmentation plan;

combining means for combining a plurality of said encoded constituent speech segments for providing a digital speech signal representative of desired animated speech corresponding to said desired speech text, said digital speech signal being representative of desired animated speech in the voice of said selected person, each of said plurality of encoded constituent speech segments corresponding to at least one of said plurality of constituent text segments; and storage means for storing said digitally encoded constituent speech segments in at least one predefined voice reference file, said predefined voice reference file comprises a language library for storing predefined sets of language rules associated with a selected language, a recording library for storing recorded speech sequences in said selected language for said selected person, a voice library for storing said encoded constituent speech segments in said selected language for said selected person, whereby a separate predefined voice reference file is defined and identified for each said selected person;

said voice library including:

at least one selectable predetermined speech segmentation plan; and a segment library associated with each said selectable predetermined speech segmentation plan for storing said constituent speech segments extracted from said speech samples in accordance with said associated speech segmentation plan.

3. Apparatus as in claim 2 further comprising a segmentation dictionary file associated with each said selectable predetermined speech segmentation plan for associating each of said speech segments in said associated segment library with a corresponding utterance containing said associated speech segment, said speech samples being derived from said utterances.

4. Apparatus as in claim 2 wherein said voice library further comprises:

a resynthesis data file associated with each said selectable predetermined speech segmentation plan for storing selected data and parameters corresponding to said selected voice; and a resynthesis configuration file associated with each said selectable predetermined speech segmentation plan for storing selected data and parameters for configurating said combining means for said selected voice utilizing said selectable predetermined speech segmentation plan.

5. Apparatus for speech animation of desired text, comprising:

first input means for receiving speech samples derived from input audio data and for providing a sample speech signal representing said speech samples;

first segmentation means including automatic extraction means coupled to said input means for automatically extracting constituent speech segments in accordance with a predetermined speech segmentation plan from said sample speech signal;

encoding means for digitally encoding said constituent speech segments;

second input means for receiving and encoding desired speech text;

second segmentation means, coupled to said second input means and responsive to desired speech text for segmenting said desired speech text into a plurality of constituent text segments in accordance with said predetermined segmentation plan;

combining means for combining a plurality of said encoded constituent speech segments for providing a digital speech signal representative of desired animated speech corresponding to said desired speech text, each of said plurality of encoded constituent speech segments corresponding to at least one of said plurality of constituent text segments;

storage means for storing said digitally encoded constituent speech segments in a predefined voice library, said speech samples being input audibly in the voice of a selected person and said predefined voice library being identified as the voice of said selected person providing said speech samples;

said voice library including at least one selectable predetermined speech segmentation plan;

a segment library associated with each said selectable predetermined speech segmentation plan for storing said constituent speech segments extracted from said speech samples in accordance with said associated speech segmentation plan; and editing means for manually editing and modifying said automatically extracted constituent speech segments.

6. Apparatus as in claim 5 wherein said editing means includes means for manually extracting said constituent speech segments from said speech samples.

7. Apparatus as in claim 6 wherein said editing means further includes:

display means for displaying a visual image of said sample speech signal and of said extracted constituent speech segments; and audio test means for providing an audio output corresponding to the constituent speech segment or segments currently being edited.

8. Apparatus as in claim 7 wherein said editing means is coupled to said combining means providing for the testing and editing of said digital speech signal.

9. Apparatus for speech animation of desired text, comprising:

first input means for receiving speech samples derived from input audio data and for providing a sample speech signal representing said speech samples, said speech samples being input in the voice of a selected person;

first segmentation means including automatic extraction means coupled to said input means for automatically extracting constituent speech segments in accordance with a predetermined speech segmentation plan from said sample speech signal, said first segmentation means including editing means for manually editing and modifying said automatically extracted constituent speech segments, said first segmentation means including means for providing a residual excitation signal associated with said sample speech signal;

encoding means for digitally encoding said constituent speech segments and said residual excitation signal as a voiced component and an unvoiced component thereof;

second input means for receiving and encoding desired speech text;

second segmentation means, coupled to said second input means and responsive to desired speech text for segmenting said desired speech text into a plurality of constituent text segments in accordance with said predetermined segmentation plan;

combining means for combining a plurality of said encoded constituent speech segments for providing a digital speech signal representative of desired animated speech corresponding to said desired speech text, each of said plurality of encoded constituent speech segments corresponding to at least one of said plurality of constituent text segments; and storage means for storing said digitally encoded constituent speech segments and said digitally encoded components of said residual excitation signal in a predefined voice library, said predefined voice library being identified as the voice of said selected person providing said speech samples;

said voice library including at least one selectable predetermined speech segmentation plan; and a segment library associated with each said selectable predetermined speech segmentation plan for storing said constituent speech segments extracted from said speech samples in accordance with said associated speech segmentation plan.

10. Apparatus as in claim 9 wherein said editing means includes means for manually extracting said constituent speech segments from said speech samples.

11. Apparatus as in claim 10 wherein said editing means further includes:

display means for displaying a visual image of said sample speech signal, said residual excitation signal and of said extracted constituent speech segments; and audio test means for providing an audio output corresponding to the speech segment or segments currently being edited.

12. Apparatus as in claim 11 wherein said editing means is coupled to said combining means providing for the testing and editing of said digital speech signal.

13. A method for providing animated speech corresponding to user input text, comprising the steps of:

receiving speech samples derived from input audio data and for providing a sample speech signal representing said speech samples;

extracting constituent speech segments from said speech samples in accordance with a predetermined segmentation plan;

encoding said constituent speech segments;

receiving and encoding desired speech text unrelated to said speech samples;

segmenting desired speech text into a plurality of constituent text segments in accordance with said predetermined segmentation plan;

combining a plurality of said encoded constituent speech segments, each of said plurality of encoded constituent speech segments corresponding to at least one of said plurality of constituent text segments for providing a speech signal representative of desired animated speech;

storing said encoded constituent speech segments in a voice library file, said voice library including at least one selectable predetermined speech segmentation plan; and a segment library associated with each said selectable predetermined speech segmentation plan for storing said constituent speech segments extracted from said speech samples in accordance with said associated speech segmentation plan; and editing said speech signal.

* * * * *